US008400318B2

(12) United States Patent
Montena

(10) Patent No.: US 8,400,318 B2
(45) Date of Patent: Mar. 19, 2013

(54) METHOD FOR DETERMINING ELECTRICAL POWER SIGNAL LEVELS IN A TRANSMISSION SYSTEM

(75) Inventor: Noah P. Montena, Syracuse, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 432 days.

(21) Appl. No.: 12/732,723

(22) Filed: Mar. 26, 2010

(65) Prior Publication Data

US 2010/0194382 A1 Aug. 5, 2010

Related U.S. Application Data

(63) Continuation-in-part of application No. 12/630,460, filed on Dec. 3, 2009, now Pat. No. 8,149,127, which is a continuation-in-part of application No. 11/860,094, filed on Sep. 24, 2007, now Pat. No. 7,733,236.

(51) Int. Cl.
*G08B 21/00* (2006.01)

(52) U.S. Cl. ..... 340/635; 340/568.1; 340/686.3

(58) Field of Classification Search ..... 340/635, 340/568.1–568.4, 572.7, 596, 686.3–686.4; 439/488–490, 578; 343/720, 894; 455/575.7, 455/97, 129

See application file for complete search history.

(56) References Cited

U.S. PATENT DOCUMENTS

| | | | |
|---|---|---|---|
| 3,196,424 | A | 7/1965 | Hardesty et al. |
| 3,388,590 | A | 6/1968 | Bond |
| 3,686,623 | A | 8/1972 | Nijman |
| 3,768,089 | A | 10/1973 | Costanzo |
| 3,808,580 | A | 4/1974 | Johnson |
| 3,945,704 | A | 3/1976 | Kraus et al. |
| 3,960,428 | A | 6/1976 | Naus et al. |
| 3,961,330 | A | 6/1976 | Davis |
| 4,084,875 | A | 4/1978 | Yamamoto |
| 4,240,445 | A | 12/1980 | Iskander et al. |
| 4,421,377 | A | 12/1983 | Spinner |
| 4,489,419 | A | 12/1984 | Wang |
| 4,911,655 | A | 3/1990 | Pinyan et al. |
| 4,915,639 | A | 4/1990 | Cohn et al. |
| 4,927,382 | A | 5/1990 | Huber |
| 5,059,948 | A | 10/1991 | Desmeules |
| 5,169,329 | A | 12/1992 | Taguchi |
| 5,194,016 | A | 3/1993 | Hatagishi et al. |
| 5,217,391 | A | 6/1993 | Fisher, Jr. |
| 5,225,816 | A | 7/1993 | Lebby et al. |
| 5,278,571 | A | 1/1994 | Helfrick |
| 5,345,520 | A | 9/1994 | Grile |
| 5,355,883 | A | 10/1994 | Ascher |

(Continued)

FOREIGN PATENT DOCUMENTS

EP 0527599 A1 2/1993

OTHER PUBLICATIONS

U.S. Appl. No. 12/732,810, filed Mar. 26, 2010, Confirmation No. 3911; Customer No. 72687.

(Continued)

*Primary Examiner* — John A Tweel, Jr.
(74) *Attorney, Agent, or Firm* — Schmeiser, Olsen & Watts, LLP

(57) ABSTRACT

A signal level detection method is provided, the method includes providing a feed line system that includes coaxial cable connectors connecting coaxial cable sections. Each coaxial cable connector includes a connector body, a coupling circuit positioned within the connector body, an electrical signal power level detection circuit electrically connected to the coupling circuit and comprised by the connector body, and an output component comprised by the connector body. At least one coupling circuit senses an electrical signal flowing through at least one associated coaxial cable connector. At least one electrical signal power level detection circuit detects a plurality of associated power levels of the electrical signal flowing through at least one associated coaxial cable connector.

42 Claims, 15 Drawing Sheets

U.S. PATENT DOCUMENTS

| | | | |
|---|---|---|---|
| 5,462,450 | A | 10/1995 | Kodama |
| 5,490,033 | A | 2/1996 | Cronin |
| 5,518,420 | A | 5/1996 | Pitschi |
| 5,561,900 | A | 10/1996 | Hosler, Sr. |
| 5,565,784 | A | 10/1996 | DeRenne |
| 5,620,330 | A | 4/1997 | Pizon |
| 5,664,962 | A | 9/1997 | Noda |
| 5,904,578 | A | 5/1999 | Kubota et al. |
| 5,924,889 | A | 7/1999 | Wang |
| 6,041,644 | A | 3/2000 | Harde |
| 6,093,043 | A | 7/2000 | Gray et al. |
| 6,134,774 | A | 10/2000 | Williams et al. |
| 6,193,568 | B1 | 2/2001 | Dorr |
| 6,243,654 | B1 | 6/2001 | Johnson et al. |
| 6,362,709 | B1 | 3/2002 | Paxman et al. |
| 6,414,636 | B1 | 7/2002 | Godard et al. |
| 6,490,168 | B1 | 12/2002 | Rochowicz et al. |
| 6,549,017 | B2 | 4/2003 | Coffeen |
| 6,570,373 | B1 | 5/2003 | Viola |
| 6,618,515 | B2 | 9/2003 | Kimura et al. |
| 6,646,447 | B2 | 11/2003 | Cern et al. |
| 6,650,885 | B2 | 11/2003 | Anderson et al. |
| 6,755,681 | B2 | 6/2004 | Chen |
| 6,783,389 | B1 | 8/2004 | Lee |
| 6,896,541 | B2 | 5/2005 | Benson |
| 6,986,665 | B2 | 1/2006 | Schauz et al. |
| 7,029,327 | B2 | 4/2006 | Devine |
| 7,084,769 | B2 | 8/2006 | Bauer et al. |
| 7,105,982 | B1 | 9/2006 | Hagood, IV et al. |
| 7,173,343 | B2 | 2/2007 | Kugel |
| 7,212,125 | B2 | 5/2007 | Shanks et al. |
| 7,254,511 | B2 | 8/2007 | Niedzwiecki et al. |
| 7,262,626 | B2 | 8/2007 | Iwasaki |
| 7,266,269 | B2 | 9/2007 | Koste et al. |
| 7,268,517 | B2 | 9/2007 | Rahmel et al. |
| 7,276,267 | B2 | 10/2007 | Schauz |
| 7,276,703 | B2 | 10/2007 | Berkcan et al. |
| 7,368,827 | B2 | 5/2008 | Kulkarni et al. |
| 7,413,353 | B2 | 8/2008 | Beer et al. |
| 7,440,253 | B2 | 10/2008 | Kauffman |
| 7,472,587 | B1 | 1/2009 | Loehndorf et al. |
| 7,479,886 | B2 | 1/2009 | Burr |
| 7,482,945 | B2 | 1/2009 | Hall |
| 7,507,117 | B2 | 3/2009 | Amidon |
| 7,513,795 | B1 | 4/2009 | Shaw |
| 7,544,086 | B1 | 6/2009 | Wells |
| 7,642,611 | B2 | 1/2010 | Tsuji et al. |
| 7,733,236 | B2 | 6/2010 | Montena et al. |
| 7,749,022 | B2 | 7/2010 | Amidon et al. |
| 7,775,115 | B2 | 8/2010 | Theuss et al. |
| 7,850,482 | B2 | 12/2010 | Montena et al. |
| 7,909,637 | B2 | 3/2011 | Montena |
| 8,149,127 | B2 * | 4/2012 | Montena ..... 340/635 |
| 2002/0090958 | A1 | 7/2002 | Ovard et al. |
| 2003/0096629 | A1 | 5/2003 | Elliott et al. |
| 2003/0148660 | A1 | 8/2003 | Devine |
| 2004/0232919 | A1 | 11/2004 | Lacey |
| 2006/0019540 | A1 | 1/2006 | Werthman et al. |
| 2007/0173367 | A1 | 7/2007 | Duncan |
| 2008/0258876 | A1 | 10/2008 | Overhultz et al. |
| 2009/0022067 | A1 | 1/2009 | Gotwals |
| 2009/0096466 | A1 | 4/2009 | Delforce et al. |
| 2009/0115427 | A1 | 5/2009 | Radtke et al. |
| 2009/0284354 | A1 | 11/2009 | Pinkham |
| 2010/0081324 | A1 | 4/2010 | Montena |
| 2010/0124838 | A1 | 5/2010 | Montena et al. |
| 2010/0124839 | A1 | 5/2010 | Montena |
| 2010/0178806 | A1 | 7/2010 | Montena |
| 2011/0080158 | A1 | 4/2011 | Lawrence et al. |
| 2011/0161050 | A1 | 6/2011 | Montena et al. |
| 2011/0237125 | A1 | 9/2011 | Montena |

OTHER PUBLICATIONS

U.S. Appl. No. 12/964,319, filed Dec. 9, 2010; Confirmation No. 4515.

U.S. Appl. No. 12/966,633, filed Dec. 13, 2010; Confirmation No. 9139.

U.S. Appl. No. 12/966,015; filed Dec. 13, 2010; Confirmation No. 7965.

U.S. Appl. No. 13/077,044; filed Oct. 31, 2011; Confirmation No. 4874.

Supplementary European Search Report for Application No. EP08834365. Date of Completion of Search: Oct. 29, 2010. 6 pages.

Office Action (Mail Date: May 19, 2011) for U.S. Appl. No. 12/630,460, filed Dec. 3, 2009; Conf. No. 9773.

Advance E-Mail PCT Notification Concerning Transmittal of International Preliminary Report on Patentability and Written Opinion. PCT/US2008/075917. Date of Mailing: Jun. 24, 2010. 9 pages. Applicant's file ref.: ID-1227-PCT.

PCT/US2010/058992; International Search Report and Written Opinion. Date of Mailing: Jul. 29, 2011. 9 pages.

PCT/US2011/030106; International Search Report and Written Opinion. Date of Mailing: Oct. 27, 2011. 9 pp.

Notice of Allowance (Mail Date: Dec. 1, 2011) for U.S. Appl. No. 12/630,460, filed Dec. 3, 2009; Conf. No. 9773.

PCT/US2011/030105. International Search Report and Written Opinion. Date of Mailing: Nov. 23, 2011. 11 pages. Applicant's file ref.: ID-1227CIP-PCT.

* cited by examiner

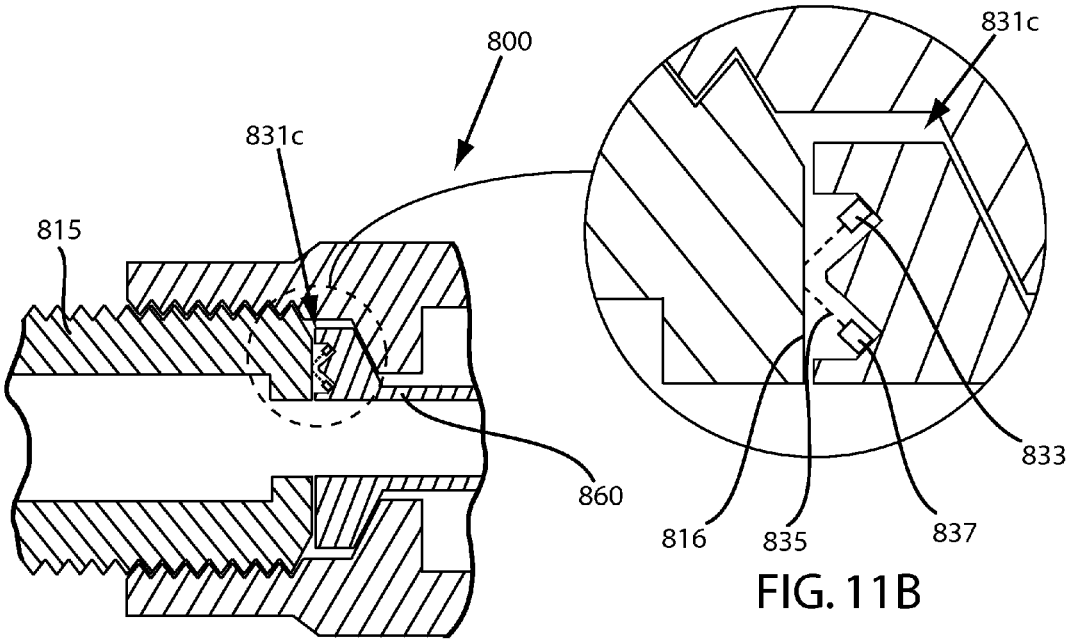
FIG. 11B
FIG. 11A
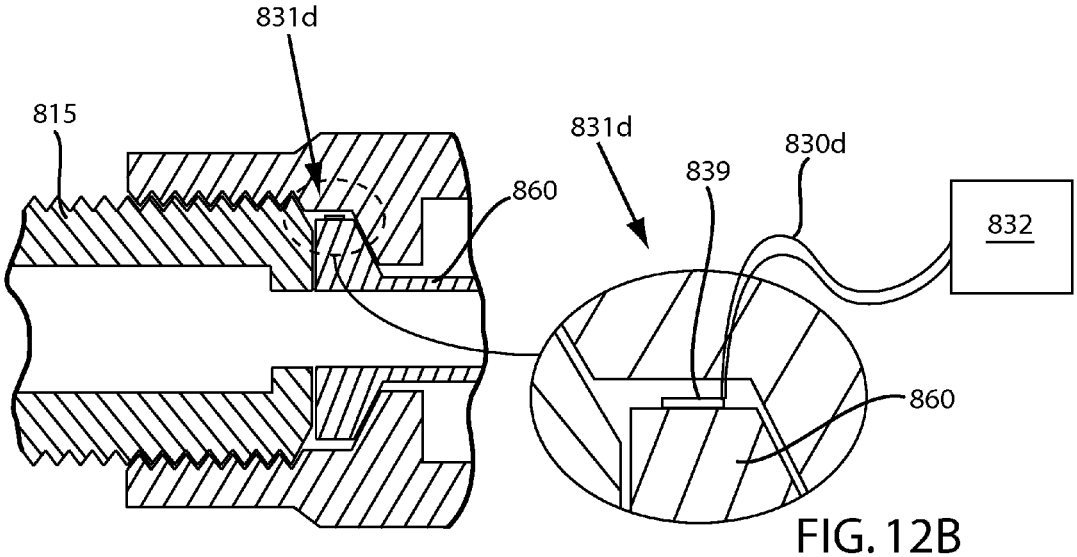
FIG. 12B
FIG. 12A

METHOD FOR DETERMINING ELECTRICAL POWER SIGNAL LEVELS IN A TRANSMISSION SYSTEM

CROSS-REFERENCE TO RELATED APPLICATIONS

This application is a continuation-in-part of and claims priority from co-pending U.S. application Ser. No. 12/630,460 filed Dec. 3, 2009, and entitled COAXIAL CABLE CONNECTOR WITH AN INTERNAL COUPLER AND METHOD OF USE THEREOF which is a continuation-in-part of and claims priority from co-pending U.S. application Ser. No. 11/860,094 filed Sep. 24, 2007, and entitled COAXIAL CABLE CONNECTOR AND METHOD OF USE THEREOF.

BACKGROUND OF THE INVENTION

1. Technical Field

The present invention relates generally to coaxial cable connectors. More particularly, the present invention relates to a coaxial cable connector and related methodology for ascertaining conditions of a signal flowing through the coaxial cable connector connected to an RF port.

2. Related Art

Cable communications have become an increasingly prevalent form of electromagnetic information exchange and coaxial cables are common conduits for transmission of electromagnetic communications. Many communications devices are designed to be connectable to coaxial cables. Accordingly, there are several coaxial cable connectors commonly provided to facilitate connection of coaxial cables to each other and/or to various communications devices.

It is important for a coaxial cable connector to facilitate an accurate, durable, and reliable connection so that cable communications may be exchanged properly. Thus, it is often important to ascertain whether a cable connector is properly connected. However, typical means and methods of ascertaining proper connection status are cumbersome and often involve costly procedures involving detection devices remote to the connector or physical, invasive inspection on-site. Hence, there exists a need for a coaxial cable connector that is configured to maintain proper connection performance, by the connector itself sensing the status of various physical parameters related to the connection of the connector, and by communicating the sensed physical parameter status through an output component of the connector. The instant invention addresses the abovementioned deficiencies and provides numerous other advantages.

SUMMARY OF THE INVENTION

The present invention provides an apparatus for use with coaxial cable connections that offers improved reliability.

A first aspect of the present invention provides a coaxial cable connector for connection to an RF port, the connector comprising: a connector body; a physical parameter status sensing circuit, positioned within the connector body, the physical parameter status sensing circuit configured to sense a condition of the connector when connected to the RF port; and a status output component, in electrical communication with the sensing circuit, the status output component positioned within the connector body and configured to maintain the status of the physical parameter.

A second aspect of the present invention provides an RF port coaxial cable connector comprising: a connector body; means for monitoring a physical parameter status located within the connector body; and means for reporting the physical parameter status of the connection of the connector to the RF port, the reporting means configured to provide the physical parameter status to a location outside of the connector body.

A third aspect of the present invention provides a coaxial cable connector connection system having an RF port, the system comprising: a coaxial cable connector, the connector having an internal physical parameter sensing circuit configured to sense a physical parameter of the connection between the connector and an RF port, the connector further having a status output component; a communications device, having the RF port to which the smart connector is coupled to form a connection therewith; and a physical parameter status reader, located externally to the connector, the reader configured to receive, via the status output component, information, from the sensing circuit, about the connection between the connector and the RF port of the communications device.

A fourth aspect of the present invention provides a coaxial cable connector connection status ascertainment method comprising: providing a coaxial cable connector having a connector body; providing a sensing circuit within the connector body, the sensing circuit having a sensor configured to sense a physical parameter of the connector when connected; providing a status output component within the connector body, the status output component in communication with the sensing circuit to receive physical parameter status information; connecting the connector to an RF port to form a connection; and reporting the physical parameter status information, via the status output component, to facilitate conveyance of the physical parameter status of the connection to a location outside of the connector body.

A fifth aspect of the present invention provides a coaxial cable connector for connection to an RF port, the connector comprising: a port connection end and a cable connection end; a mating force sensor, located at the port connection end; a humidity sensor, located within a cavity of the connector, the cavity extending from the cable connection end; and a weather-proof encasement, housing a processor and a transmitter, the encasement operable with a body portion of the connector; wherein the mating force sensor and the humidity sensor are connected via a sensing circuit to the processor and the output transmitter.

A sixth aspect of the present invention provides an RF port coaxial cable connector comprising: a connector body; a control logic unit and an output transmitter, the control logic unit and the output transmitter housed within an encasement located radially within a portion of the connector body; and a sensing circuit, electrically linking a mating force sensor and a humidity sensor to the control logic unit and the output transmitter.

A seventh aspect of the present invention provides a coaxial cable connector for connection to an RF port, the connector comprising: a connector body; a coupling circuit, said coupling circuit positioned within the connector body, said coupling circuit configured to sense an electrical signal flowing through the connector when connected to the RF port; and an electrical parameter sensing circuit electrically connected to said coupling circuit, wherein said electrical parameter sensing circuit is configured to sense a parameter of said electrical signal flowing through the RF port, and wherein said electrical parameter sensing circuit is positioned within the connector body.

An eighth aspect of the present invention provides an RF port coaxial cable connector comprising: a connector body; means for sensing an electrical signal flowing through the connector when connected to the RF port, wherein said means for sensing said electrical signal is located within said connector body; and means for sensing a parameter of said electrical signal flowing through the RF port, wherein said for sensing said parameter of said electrical signal is located within said connector body.

A ninth aspect of the present invention provides a coaxial cable connector connection system having an RF port, the system comprising: a connector comprising a connector body, a coupling circuit within the connector body, and an electrical parameter sensing circuit electrically connected to said coupling circuit, wherein said coupling circuit is configured to sense an electrical signal flowing through the connector when connected to the RF port, and wherein said electrical parameter sensing circuit is configured to sense a parameter of said electrical signal flowing through the RF port; a communications device comprising the RF port to which the connector is coupled to form a connection; and a parameter reading device located externally to the connector, wherein the parameter reading device is configured to receive a signal comprising a reading associated with said parameter.

A tenth aspect of the present invention provides a coaxial cable connection method comprising: providing a coaxial cable connector comprising a connector body, a coupling circuit, positioned within the connector body, an electrical parameter sensing circuit electrically connected to the coupling circuit, and an output component positioned within the connector body, wherein said electrical parameter sensing circuit is positioned within the connector body, wherein said coupling circuit is configured to sense an electrical signal flowing through the connector when connected to an RF port, wherein said electrical parameter sensing circuit is configured to sense a parameter of said electrical signal flowing through the RF port, and wherein the output component is in communication with said electrical parameter sensing circuit to receive a reading associated with said parameter; connecting the connector to said RF port to form a connection; and reporting the reading associated with said parameter, via the output component, to communicate the reading to a location external to said connector body.

An eleventh aspect of the present invention provides a signal level detection method comprising: providing a transmission system comprising a signal receiving device, a signal emitting source, and a feed line system connected between said signal receiving device and said signal emitting source, wherein said feed line system comprises a plurality of coaxial cable connectors connected between a plurality of coaxial cable sections, wherein each coaxial cable connector of said coaxial cable connectors comprises a connector body, a coupling circuit positioned within the connector body, an electrical signal power level detection circuit electrically connected to said coupling circuit and comprised by the connector body, and an output component comprised by the connector body, and wherein said output component is in communication with said electrical parameter sensing circuit; sensing, by at least one said coupling circuit, an electrical signal flowing through at least one associated coaxial cable connector of said plurality of coaxial cable connectors; and detecting, by at least one said electrical signal power level detection circuit, a plurality of associated power levels of said electrical signal flowing through said at least one associated coaxial cable connector.

A twelfth aspect of the present invention provides a signal level detection method comprising: providing a computing system comprising a computer processor; receiving, by said computer processor from a plurality of electrical signal power level detection circuits comprised by a plurality of coaxial cable connectors, a first plurality of power levels of an electrical signal flowing through each coaxial cable connector of said plurality of coaxial cable connectors, wherein said plurality of coaxial cable connectors are comprised by a transmission system comprising a signal receiving device, a signal emitting source, and a feed line system connected between said signal receiving device and said signal emitting source, wherein said feed line system comprises said plurality of coaxial cable connectors connected between a plurality of coaxial cable sections, wherein each coaxial cable connector of said coaxial cable connectors comprises a connector body, a coupling circuit positioned within the connector body, an electrical signal power level detection circuit of said plurality of electrical signal power level detection circuits comprised by the connector body, and an output component comprised by the connector body, and wherein each said coupling circuit senses said electrical signal flowing through an associated coaxial cable connector of said plurality of coaxial cable connectors; comparing, by said computer processor, each power level of said first plurality of power levels to each other power level of said first plurality of power levels; first determining, by said computer processor based on results of said comparing, that there are first distinct power levels of said plurality of power levels; and second determining, by said computer processor based on said first distinct power levels, that a malfunction may be present at a location associated with at least one coaxial cable connector of said plurality of coaxial cable connectors or a location associated with said feed system.

The foregoing and other features of the invention will be apparent from the following more particular description of various embodiments of the invention.

DESCRIPTION OF THE DRAWINGS

Some of the embodiments of this invention will be described in detail, with reference to the following figures, wherein like designations denote like members, wherein:

FIG. 11A depicts a partial side cross-sectional view of an embodiment a connector mated to an RF port, the connector having an optical connection tightness sensor, in accordance with the present invention;

FIG. 11B depicts a blown up view of the optical connection tightness sensor depicted in FIG. 11A, in accordance with the present invention;

FIG. 12A depicts a partial side cross-sectional view of an embodiment a connector mated to an RF port, the connector having a strain gauge connection tightness sensor, in accordance with the present invention;

FIG. 12B depicts a blown up view of the strain gauge connection tightness sensor depicted in FIG. 12A, as connected to further electrical circuitry, in accordance with the present invention;

DETAILED DESCRIPTION OF THE INVENTION

Figure 1:
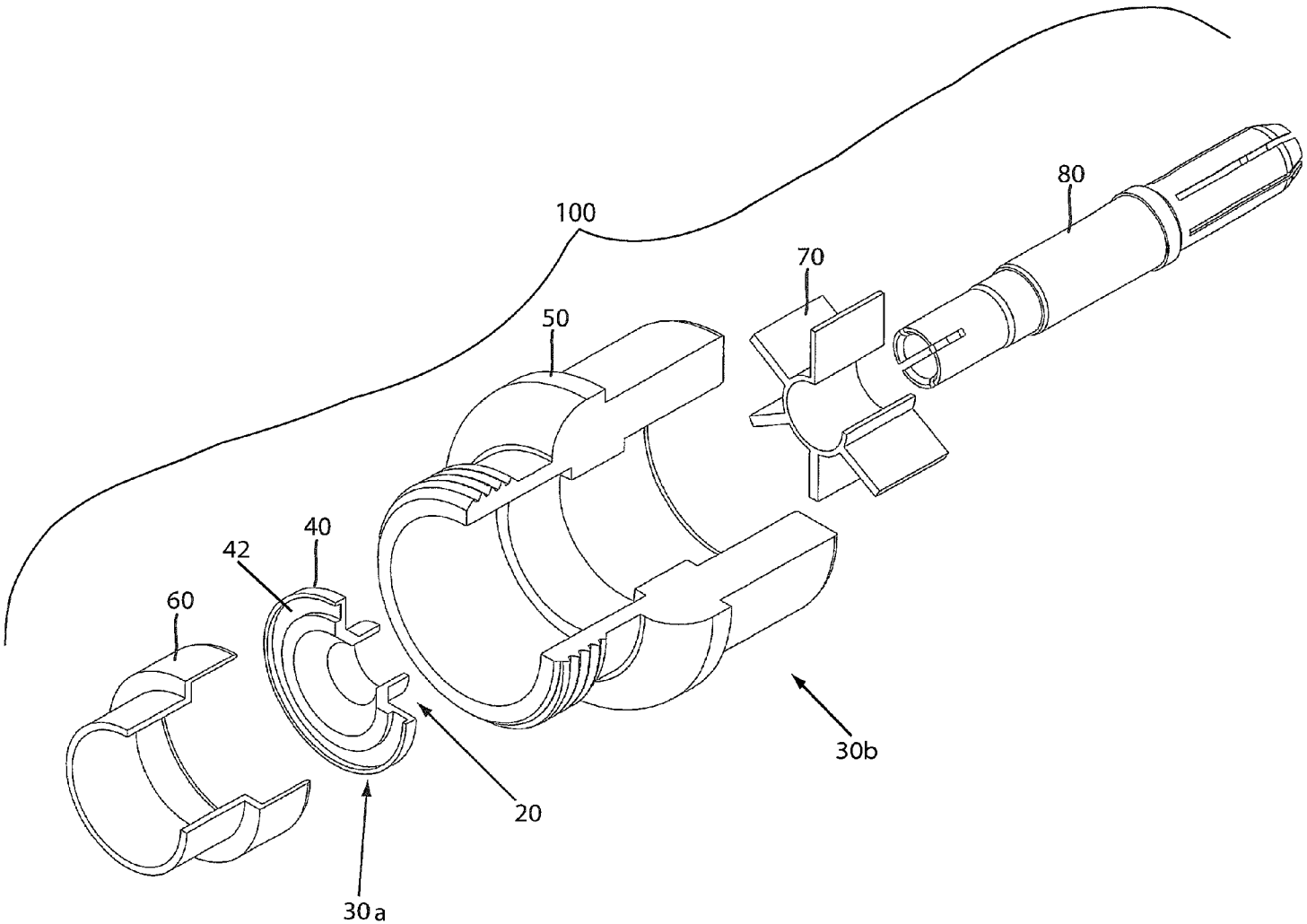
FIG. 1 depicts an exploded cut-away perspective view of an embodiment of a coaxial cable connector with a sensing circuit, in accordance with the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., which are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

It is often desirable to ascertain conditions relative to a coaxial cable connector connection or relative to a signal flowing through a coaxial connector. A condition of a connector connection at a given time, or over a given time period, may comprise a physical parameter status relative to a connected coaxial cable connector. A physical parameter status is an ascertainable physical state relative to the connection of the coaxial cable connector, wherein the physical parameter status may be used to help identify whether a connector connection performs accurately. A condition of a signal flowing through a connector at a given time, or over a given time period, may comprise an electrical parameter of a signal flowing through a coaxial cable connector. An electrical parameter may comprise, among other things, an electrical signal (RF) power level, wherein the electrical signal power level may be used for discovering, troubleshooting and eliminating interference issues in a transmission line (e.g., a transmission line used in a cellular telephone system). Additionally, the electrical signal power level may be used for discovering, troubleshooting and eliminating interference issues in a passive intermodulation (PIM) in a transmission line (e.g., a transmission line used in a cellular telephone system). PIM occurs when two or more signals are present in a passive device (e.g., a cable, a connector, an isolator, a switch, etc.) and exhibit a nonlinear response. PIM may be detected by monitoring an intensity of RF power levels continuously and reporting associated data (e.g., comprising distinct power levels of an electrical signal within one or more connectors) along with a physical state data back to a central intelligence unit. The intelligence unit may then map RF power with time and position within a transmission system. Over time, a normal range of power for a given connector(s) may be defined. Sudden increases, particularly increases in near band frequencies corresponding to $3^{rd}$, $5^{th}$, $7^{th}$, etc. order harmonics to a main frequency band (which could be filtered and/or have the power pick-up antenna tuned for), may indicate PIM. Compared with data from a same connector and/or other connectors in a chain, the data from the connectors closest to the PIM source may be isolated.

Embodiments of a connector 100 of the present invention may be considered "smart", in that the connector 100 itself ascertains physical parameter status pertaining to the connection of the connector 100 to an RF port. Additionally, embodiments of a connector 100 of the present invention may be considered "smart", in that the connector 100 itself detects and measures a parameter of an electrical signal (e.g., an RF power level) flowing through a coaxial connector.

Figure 2:
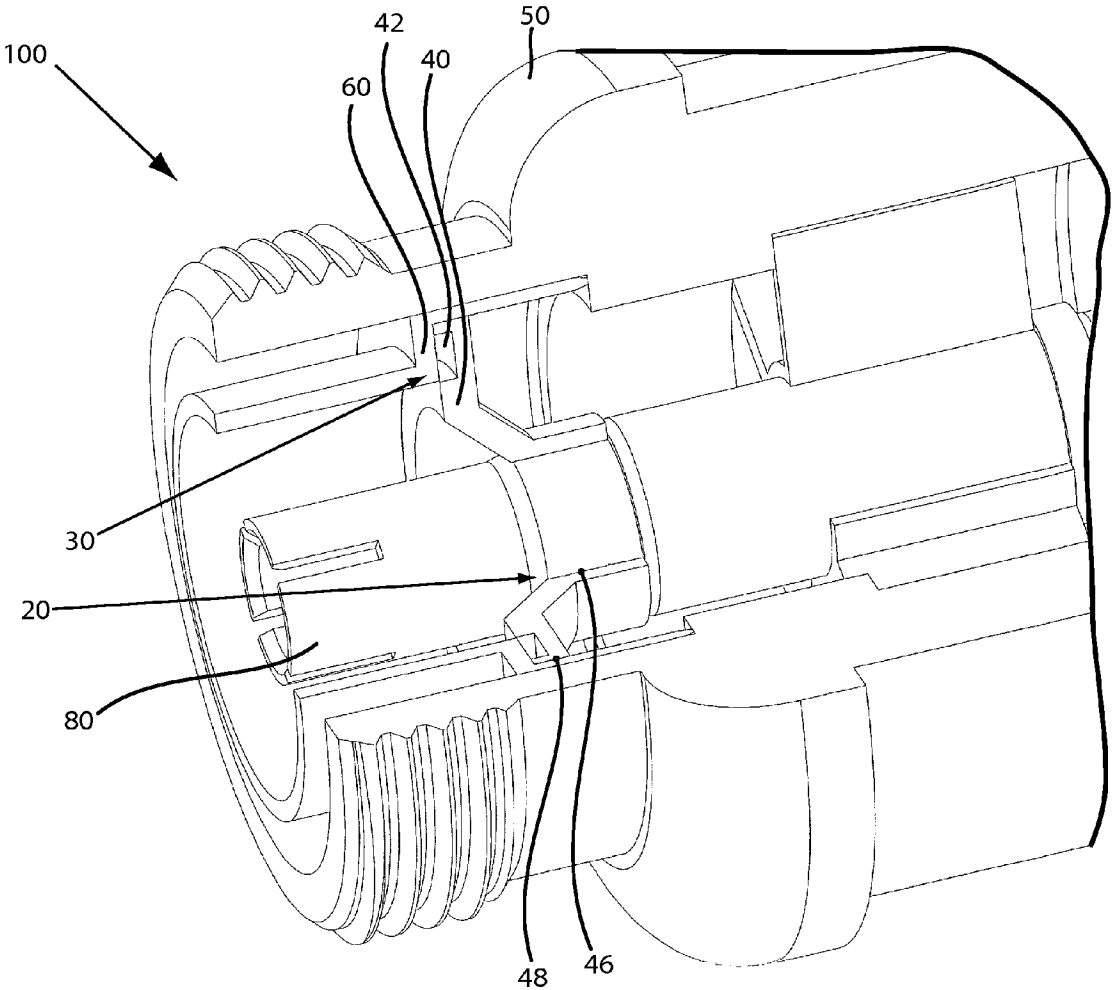
FIG. 2 depicts a close-up cut-away partial perspective view of an embodiment of a coaxial cable connector with a sensing circuit, in accordance with the present invention.
Figure 3:
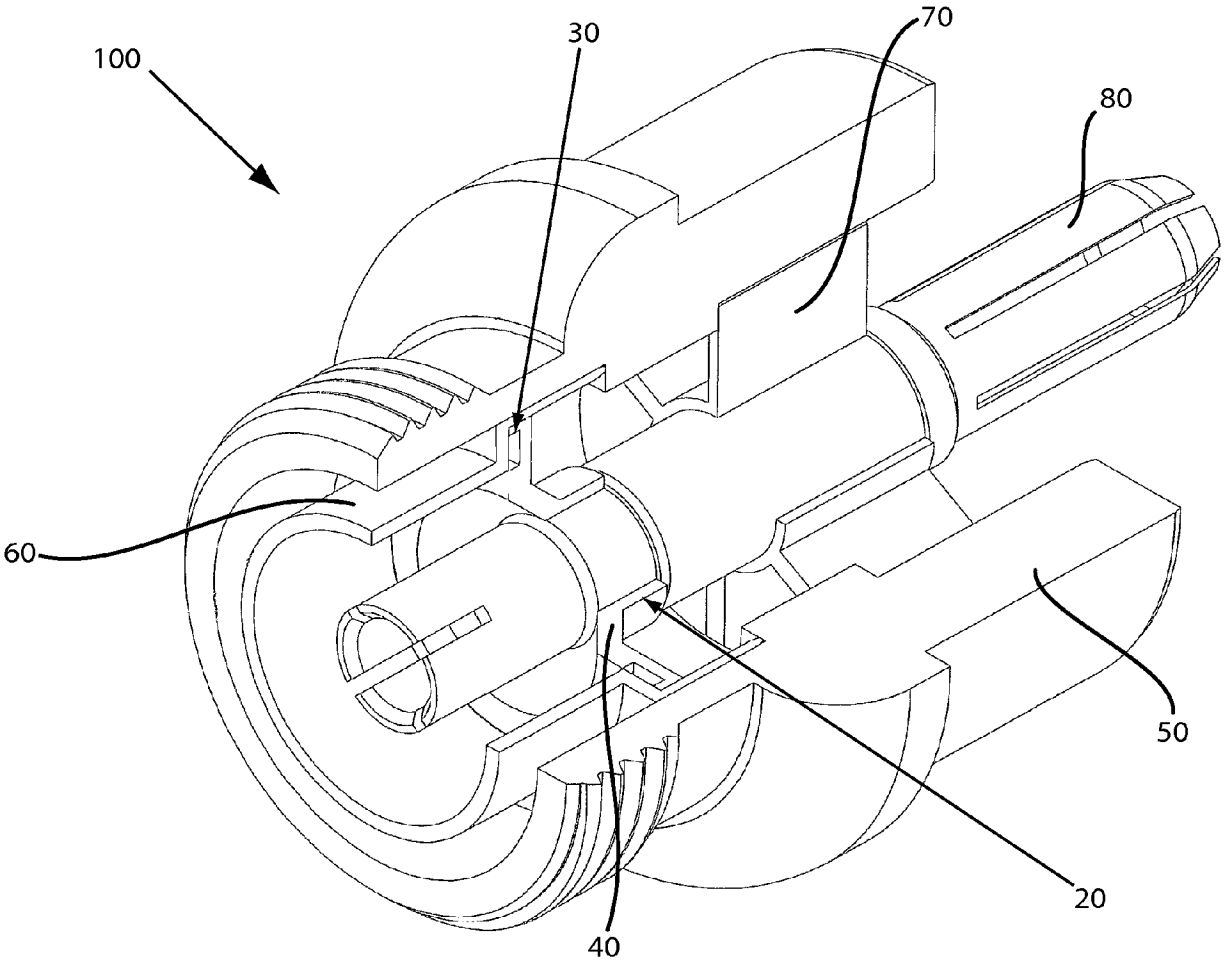
FIG. 3 depicts a cut-away perspective view of an embodiment of an assembled coaxial cable connector with an integrated sensing circuit, in accordance with the present invention.

Referring to the drawings, FIGS. 1-3 depict cut-away perspective views of an embodiment of a coaxial cable connector 100 with an internal sensing circuit 30, in accordance with the present invention. The connector 100 includes a connector body 50. The connector body 50 comprises a physical structure that houses at least a portion of any internal components of a coaxial cable connector 100. Accordingly the connector body 50 can accommodate internal positioning of various components, such as a first spacer 40, an interface sleeve 60, a second spacer 70, and/or a center conductor contact 80 that may be assembled within the connector 100. In addition, the connector body 50 may be conductive. The structure of the various component elements included in a connector 100 and the overall structure of the connector 100 may operably vary. However, a governing principle behind the elemental design of all features of a coaxial connector 100 is that the connector 100 should be compatible with common coaxial cable interfaces pertaining to typical coaxial cable communications devices. Accordingly, the structure related to the embodiments of coaxial cable connectors 100 depicted in the various FIGS. 1-6 is intended to be exemplary. Those in the art should appreciate that a connector 100 may include any operable structural design allowing the connector 100 to sense a condition of a connection of the connector 100 with an interface to an RF port of a common coaxial cable communications device, and also report a corresponding connection performance status to a location outside of the connector 100. Additionally, connector 100 may include any operable structural design allowing the connector 100 to sense, detect, and measure a parameter of an electrical signal flowing through connector 100.

A coaxial cable connector 100 has internal circuitry that may sense connection conditions, store data, and/or determine monitorable variables of physical parameter status such as presence of moisture (humidity detection, as by mechanical, electrical, or chemical means), connection tightness (applied mating force existent between mated components), temperature, pressure, amperage, voltage, signal level, signal frequency, impedance, return path activity, connection location (as to where along a particular signal path a connector 100 is connected), service type, installation date, previous service call date, serial number, etc. A connector 100 includes a physical parameter status sensing/an electrical parameter sensing circuit 30. A sensing circuit 30 may be integrated onto typical coaxial cable connector components. The sensing circuit 30 may be located on existing connector structures. For example, a connector 100 may include a component such as a first spacer 40 having a face 42. A sensing circuit 30 may be positioned on the face 42 of the first spacer 40 of the connector 100. The physical parameter status sensing circuit 30 is configured to sense a condition of the connector 100 when the connector 100 is connected with an interface of a common coaxial cable communications device, such as interface port 15 of receiving box 8 (see FIG. 5). Moreover, various portions of the circuitry of a sensing circuit 30 may be fixed onto multiple component elements of a connector 100.

Power for the physical parameter status sensing circuit 30 and/or other powered components of a connector 100 may be provided through electrical communication with the center conductor 80. For instance, traces may be printed on the first spacer 40 and positioned so that the traces make electrical contact with the center conductor contact 80 at a location 46 (see FIG. 2). Contact with the center conductor contact 80 at location 46 facilitates the ability for the sensing circuit 30 to draw power from the cable signal(s) passing through the center conductor contact 80. Traces may also be formed and positioned so as to make contact with grounding components. For example, a ground path may extend through a location 48 between the first spacer 40 and the interface sleeve 60, or any other operably conductive component of the connector 100. A connector 100 may be powered by other means. For example, the connector 100 may include a battery, a micro fuel cell, a solar cell or other like photovoltaic cell, a radio frequency transducer for power conversion from electromagnet transmissions by external devices, and/or any other like powering means. Power may come from a DC source, an AC source, or an RF source. Those in the art should appreciate that a physical parameter status sensing circuit 30 should be powered in a way that does not significantly disrupt or interfere with electromagnetic communications that may be exchanged through the connector 100.

Figure 4A:
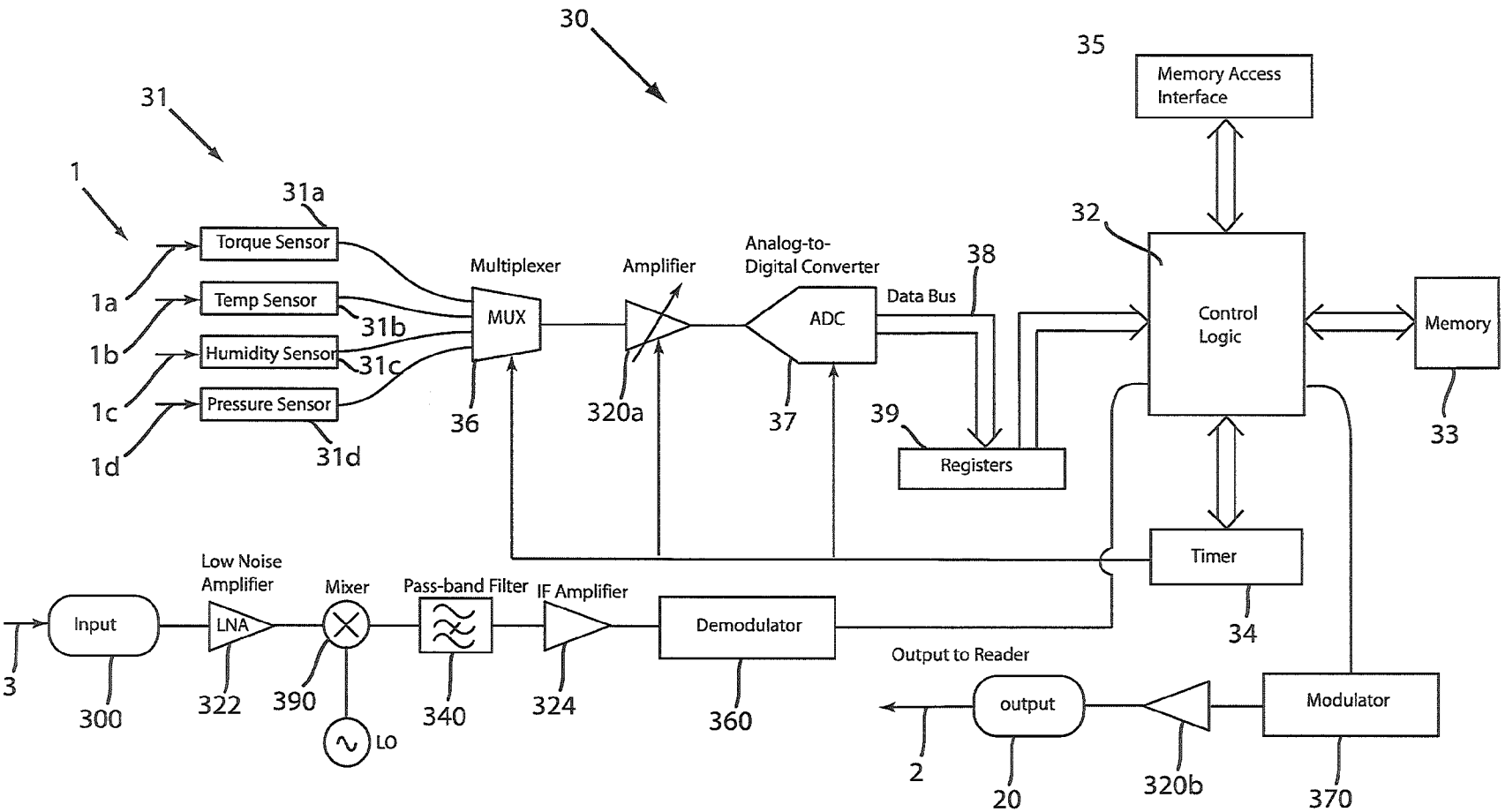
FIG. 4A depicts a schematic view of an embodiment of a sensing circuit, in accordance with the present invention.

With continued reference to the drawings, FIG. 4A depicts a schematic view of an embodiment of a physical parameter status sensing circuit 30. Embodiments of a physical parameter status sensing circuit 30 may be variably configured to include various electrical components and related circuitry so that a connector 100 can measure or determine connection performance by sensing a condition 1 relative to the connection of the connector 100, wherein knowledge of the sensed condition 1 may be provided as physical parameter status information and used to help identify whether the connection performs accurately. Accordingly, the circuit configuration as schematically depicted in FIG. 4A is provided to exemplify one embodiment of a sensing circuit 30 that may operate with a connector 100. Those in the art should recognize that other circuit 30 configurations may be provided to accomplish the sensing of physical parameters corresponding to a connector 100 connection. For instance, each block or portion of the sensing circuit 30 can be individually implemented as an analog or digital circuit.

As schematically depicted, a sensing circuit 30 may comprise one or more sensors 31. For example, the sensing circuit 30 may include a torque sensor 31*a* configured to detect the tightness of the connection of the connector 100 with an interface of another coaxial communications device having an RF port. The torque sensor 31*a* may measure, determine, detect, or otherwise sense a connection condition 1*a*, such as the mating force resultant from the physical connection of the connector 100 with the interface, such as RF port 15 of the receiving box 8 (see FIG. 5). A connector 100 may include a plurality of sensors 31. For instance, in addition to a torque sensor 31*a*, a connector 100 may include: a temperature sensor 31*b* configured to sense a connection condition 1*b*, such as the temperature of all or a portion of the connector 100; a humidity sensor 31*c* configured to sense a connection condition 1*c*, such as the presence and amount of any moisture or water vapor existent in the connector 100 and/or in the connection between the connector 100 and an interface with another cable communications device; and a pressure sensor 31*d* configured to sense a connection 1*d*, such as the pressure existent in all or a portion of the connector 100 and/or in the overall connection involving the connector 100 and an interface with another cable communications device. Other sensors may also be included in a sensing circuit 30 to help detect connection conditions 1 related to physical parameters such as amperage, voltage, signal level, signal frequency, impedance, return path activity, connection location (as to where along a particular signal path a connector 100 is connected), service type, installation date, previous service call date, serial number, etc.

A sensed connection condition 1 may be electrically communicated within a sensing circuit 30 from a sensor 31. For example the sensed condition may be communicated as physical parameter status information to a control logic unit 32. The control logic unit 32 may include and/or operate with protocol to govern what, if any, actions can/should be taken with regard to the sensed condition 1 following its electrical communication to the control logic unit 32. The control logic unit 32 may be a microprocessor or any other electrical component or electrical circuitry capable of processing a signal based on governing logic. A memory unit 33 may be in electrical communication with the control logic unit 32. The memory unit 33 may store physical parameter status information related to sensed connection conditions 1. The stored physical parameter status information may then be later communicated or processed by the control logic unit 32 or otherwise operated on by the sensing circuit 30. Furthermore the memory unit 33 may be a component or device that may store governing protocol. The governing protocol may be instructions that form a computer program, or may be simple logic commands. Stored protocol information that governs control logic operations may comprise a form of stored program architecture versatile for processing over some interval of time. A sensing circuit 30 may accordingly include a timer 34. In addition, a sensing circuit 30 may include a memory access interface 35. The memory access interface 35 may be in electrical communication with the control logic unit 32.

Various other electrical components may be included in embodiments of a sensing circuit 30. For example, where the circuit 30 includes multiple sensors 31, a multiplexer 36 may be included to integrate signals from the various sensors 31. Moreover, depending on signal strength coming from a sensor 31, a sensing circuit 30 may include an amplifier 320*a* to adjust the strength of the signal from the sensor 31 sufficient to be operated on by other electrical components, such as the control logic unit 32. Additionally, an ADC unit 37 (analog-to-digital converter) may be included in a sensing circuit 30.

The ADC unit 37 may, if needed, convert analog signals originating from the sensors 31 to digital signals. The multiplexer 36, ADC unit 37 and amplifier 320*a*, may all be in parallel with the control logic unit 32 and the timer 34 helping to coordinate operation of the various components. A data bus 38 may facilitate transfer of signal information between a sensor 31 and the control logic unit 32. The data bus 38 may also be in communication with one or more registers 39. The registers 39 may be integral to the control logic unit 32, such as microcircuitry on a microprocessor. The registers 39 generally contain and/or operate on signal information that the control logic unit 32 may use to carry out sensing circuit 30 functions, possibly according to some governing protocol. For example, the registers 39 may be switching transistors integrated on a microprocessor, and functioning as electronic "flip-flops."

A sensing circuit 30 may include and/or operate with an input component 300. The input component 300 may receive input signals 3, wherein the input signals 3 may originate from a location outside of the connector 100. For example, the input component 300 may comprise a conductive element that is physically accessible by a communications device, such as a wire lead 410 from a reader 400*a* (see FIG. 5). The sensing circuit 30 may be electrically linked by traces, leads, wires, or other electrical conduits located within a connector 100*a* to electrically connect an external communications device, such as the reader 400*a*. An input signal 3 may originate from a reader 400*a* located outside of the connector, wherein the reader 400*a* transmits the input signal 3 through a wire lead 410*a-b* in electrical contact with the connector 100*a* so that the input signal 3 passes through the input component 300 and to the electrically connected sensing circuit 30. In addition, a sensing circuit 30 may include and/or operate with an input component 300, wherein the input component 300 is in electrical contact with the center conductor of a connected coaxial cable 10. For instance, the input component 300 may be a conductive element, such as a lead, trace, wire or other electrical conduit, that electrically connects the sensing circuit 30 to the center conductor contact 80 at or near a location 46 (see FIG. 2). Accordingly, an input signal 5 may originate from some place outside of the connector 100, such as a point along the cable line, and be passed through the cable 10 until the input signal 5 is inputted through the input component 300 into the connector 100 and electrically communicated to the sensing circuit 30. Thus a sensing circuit 30 of a connector 100 may receive input signals from a point somewhere along the cable line, such as the head end. Still further, an input component 300 may include wireless capability. For example the input component 300 may comprise a wireless receiver capable of receiving electromagnet transmissions, such as, radio-waves, Wi-fi transmissions, RFID transmissions, BLUETOOTH™ (open wireless technology standard) wireless transmissions, and the like. Accordingly, an input signal, such as wireless input signal 4 depicted in FIG. 5, may originate from some place outside of the connector 100, such as a wireless reader 400*b* located a few feet from the connector 100, and be received by the input component 300 in the connector 100 and then electrically communicated to the sensing circuit 30.

A sensing circuit 30 may include various electrical components operable to facilitate communication of an input signal 3, 4, 5 received by an input component 300. For example, a sensing circuit 30 may include a low noise amplifier 322 in electrical communication with a mixer 390. In addition, a sensing circuit 30 may include a pass-band filter 340 configured to filter various signal band-widths related to incoming input signals 3, 4, 5. Furthermore, a sensing circuit may include an IF amplifier 324 configured to amplify intermediate frequencies pertaining to received input signals 3-5 communicated through the input component 300 to the sensing circuit 30. If needed, a sensing circuit 30 may also include a demodulator 360 in electrical communication with the control logic unit 32. The demodulator 360 may be configured to recover the information content from the carrier wave of a received input signal 3, 4, 5.

Monitoring a physical parameter status of a connection of the connector 100 may be facilitated by an internal sensing circuit 30 configured to report a determined condition of the connector 100 connection. The sensing circuit 30 may include a signal modulator 370 in electrical communication with the control logic unit 32. The modulator 370 may be configured to vary the periodic waveform of an output signal 2, provided by the sensing circuit 30. The strength of the output signal 2 may be modified by an amplifier 320*b*. Ultimately the output signal 2 from the sensing circuit 30 is transmitted to an output component 20 in electrical communication with the sensing circuit 30. Those in the art should appreciate that the output component 20 may be a part of the sensing circuit 30. For example the output component 20 may be a final lead, trace, wire, or other electrical conduit leading from the sensing circuit 30 to a signal exit location of a connector 100.

Embodiments of a connector 100 include a physical parameter status output component 20 in electrical communication with the sensing circuit 30. The status output component 20 is positioned within the connector body 50 and configured to facilitate reporting of information relative to one or more sensed conditions comprising a physical parameter status to a location outside of the connector body 50. An output component 20 may facilitate the dispatch of information pertaining to a physical parameter status associated with condition(s) 1 sensed by a sensor 31 of a sensing circuit 30 and reportable as information relative to the performance of the connection of a connector 100. For example, the sensing circuit 30 may be in electrical communication with the center conductor contact 80 through a status output component 20, such as a lead or trace, in electrical communication with the sensor circuit 30 and positioned to electrically connect with the center conductor contact 80 at a location 46 (see FIG. 2). Sensed physical parameter status information may accordingly be passed as an output signal 2 from the sensing circuit 30 of the first spacer 40 through the output component 20, such as traces electrically linked to the center conductor contact 80. The outputted signal(s) 2 can then travel outside of the connector 100 along the cable line (see FIG. 5) corresponding to the cable connection applicable to the connector 100. Hence, the reported physical parameter status may be transmitted via output signal(s) 2 through the output component 20 and may be accessed at a location along the cable line outside of the connector 100. Moreover, the status output component 20 may comprise a conductive element that is physically accessible by a communications device, such as a wire lead 410 from a reader 400*a* (see FIG. 5).

The sensing circuit 30 may be electrically linked by traces, leads, wires, or other electrical conduits located within a connector, such as connector 100*a*, to electrically communicate with an external communications device, such as the reader 400*a*. An output signal 2 from the sensing circuit 30 may dispatch through the status output component 20 to a reader 400*a* located outside of the connector, wherein the reader 400*a* receives the output signal 2 through a wire lead 410 in electrical contact with the connector 100*a*. In addition, a status output component 20 may include wireless capability. For example the output component 20 may comprise a wireless transmitter capable of transmitting electromagnet signals, such as, radio-waves, Wi-fi transmissions, RFID transmissions, satellite transmissions, BLUETOOTH™ (open wireless technology standard) wireless transmissions, and the like. Accordingly, an output signal, such as wireless output signal 2*b* depicted in FIG. 5, may be reported from the sensing circuit 30 and dispatched through the status output component 20 to a device outside of the connector 100, such as a wireless reader 400*b* located a few feet from the connector 100. A status output component 20 is configured to facilitate conveyance of the physical parameter status to a location outside of the connector body 50 so that a user can obtain the reported information and ascertain the performance of the connector 100. The physical parameter status may be reported via an output signal 2 conveyed through a physical electrical conduit, such as the center conductor of the cable 10, or a wire lead 410 from a reader 400*a* (see FIG. 5).

Figure 4B:
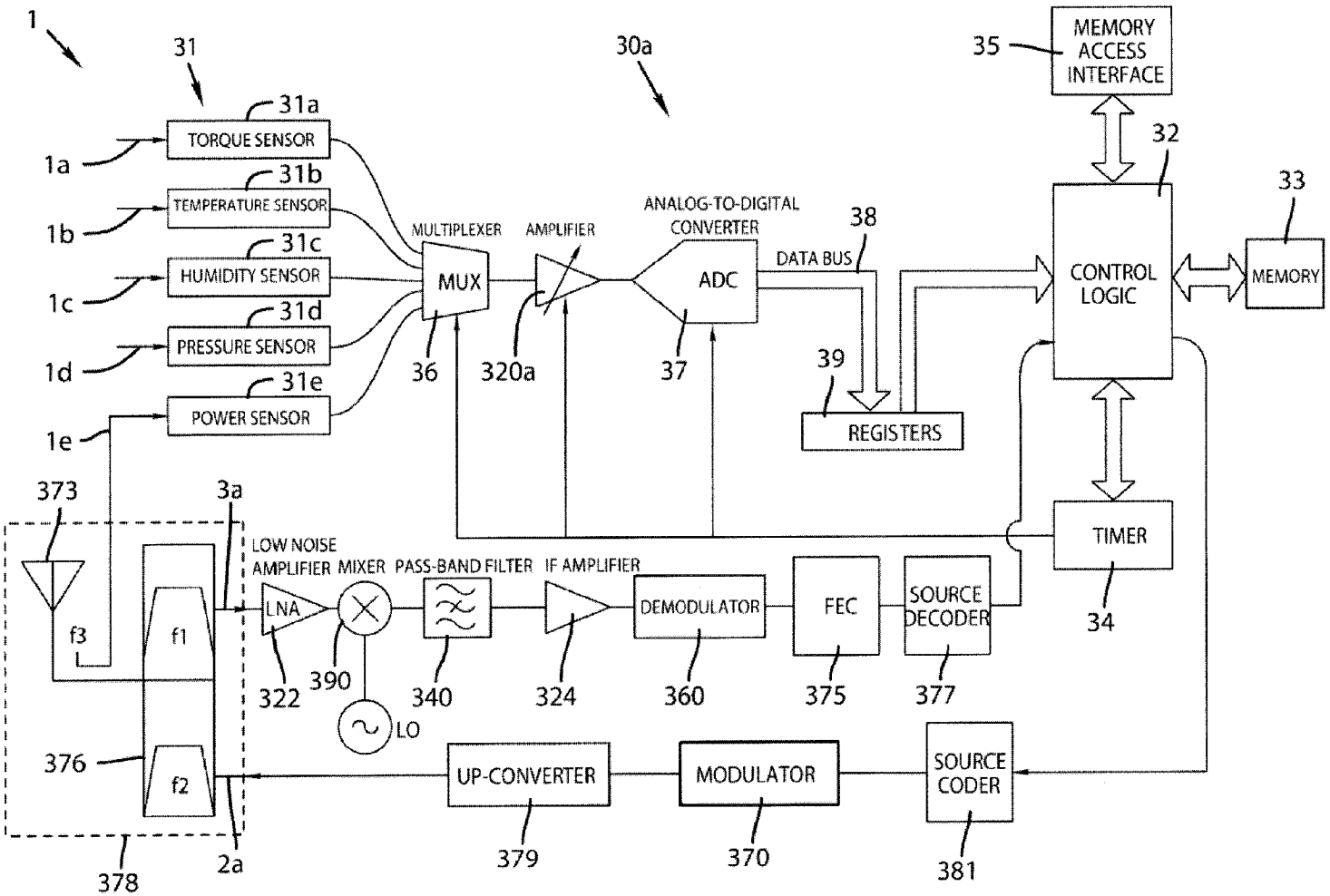
FIG. 4B depicts a schematic view of an embodiment of a signal sensing circuit, in accordance with the present invention.

With continued reference to the drawings, FIG. 4B (i.e., a modified embodiment with respect to FIG. 4A) depicts a schematic view of an embodiment of a (electrical) signal parameter sensing circuit 30*a*. In addition to or in contrast with sensing circuit 30 of FIG. 4A, embodiments of a signal parameter sensing circuit 30*a* of FIG. 4B may be variably configured to include various electrical components and related circuitry so that a connector 100 can measure or determine an electrical signal parameter (e.g., an RF signal power level) of an electrical signal flowing through connector 100 in order to determine for example, interference in a transmission line, PIM in a transmission line and/or connectors, etc. Accordingly, the circuit configuration as schematically depicted in FIG. 4B is provided to exemplify one embodiment of a sensing circuit 30*a* that may operate with a connector 100. Those in the art should recognize that other circuit 30*a* configurations may be provided to accomplish the sensing of electrical signal parameters of an electrical signal flowing through connector 100. For instance, each block or portion of the sensing circuit 30*a* can be individually implemented as an analog or digital circuit.

As schematically depicted, sensing circuit 30*a* may comprise a power sensor 31*e* and a coupling circuit 378. Coupling circuit 378 may comprise a coupler (i.e., a coupling device) 373. Coupler 373 may comprise, among other things, a directional coupler such as, for example, an antenna. Coupler 373 may be coupled to center conductor 80 of connector 100. Additionally, coupler 373 may be coupled to center conductor 80 of connector 100 directly or indirectly. Coupler 373 may comprise a single coupler or a plurality of couplers. Additional couplers and/or sensors may also be included in sensing circuit 30*a* to help detect signal conditions or levels of a signal such as amperage, voltage, signal level, signal frequency, impedance, return path activity, connection location (as to where along a particular signal path a connector 100 is connected), service type, installation date, previous service call date, serial number, etc.

A sensed electrical signal 1*e* may be electrically communicated within sensing circuit 30*a* from coupler 373 to sensor 31*e*. Sensor 31*a* retrieves the electrical signal from coupler 373 and measures a parameter of the electrical signal (e.g., an RF power level of the electrical signal). The parameter may be transmitted within circuit 30*a*. For example the parameter may be communicated as electrical signal parameter information to a control logic unit 32. The control logic unit 32 may include and/or operate with protocol to govern what, if any, actions can/should be taken with regard to the sensed condition 1*e* following its electrical communication to the control logic unit 32. Memory unit 33 may be in electrical communication with the control logic unit 32 and may store electrical signal parameter information related to sensed electrical signal 1*e*. The stored electrical signal parameter information may then be later communicated or processed by the control logic unit 32 or otherwise operated on by the sensing circuit 30*a*.

In addition to the components described with reference to FIG. 4A and illustrated in FIG. 4B, various other electrical components may be included in embodiments of sensing circuit 30*a*. For example, sensing circuit 30*a* may include and/or operate with a diplexer 376 (i.e., comprised by coupling circuit 378) connected to coupler 373. A diplexer is a passive device that implements frequency domain multiplexing. Diplexer 376 comprises two ports (F1 and F2) multiplexed onto a third port (F3). Coupler 373 may receive input signals 3*a* and pass the input signals 3*a* through port F1, wherein the input signals 3*a* may originate from a location outside of the connector 100. For example, the coupler 373 may be physically accessible by a communications device, such as a wire lead 410 from a reader 400*a* (see FIG. 5). The sensing circuit 30*a* may be additionally electrically linked by traces, leads, wires, or other electrical conduits located within a connector 100*a* to electrically connect an external communications device, such as the reader 400*a*. An input signal 3*a* may originate from a reader 400*a* located outside of the connector, wherein the reader 400*a* transmits the input signal 3*a* through a wire lead 410*a-b* in electrical contact with the connector 100*a* so that the input signal 3*a* passes through the input component 300 and to the electrically connected sensing circuit 30. Accordingly, input signal 3*a* may originate from some place outside of the connector 100, such as a point along the cable line, and be passed through the cable 10 until the input signal 3*a* is inputted through coupler 373 into the connector 100 and electrically communicated to the sensing circuit 30*a*. Thus a sensing circuit 30*a* of a connector 100 may receive input signals from a point somewhere along the cable line, such as the head end. Coupler 373 includes wireless capability. For example coupler 373 comprises a wireless receiver capable of receiving electromagnet transmissions, such as, radio-waves, Wi-fi transmissions, RFID transmissions, BLUETOOTH™ (open wireless technology standard) wireless transmissions, and the like. Accordingly, an input signal, such as wireless input signal 4 depicted in FIG. 5, may originate from some place outside of the connector 100, such as a wireless reader 400*b* located a few feet from the connector 100, and be received by coupler 373 in the connector 100 and then electrically communicated to the sensing circuit 30*a*. Alternatively, coupling circuit 378 may comprise a time division multiplexer/demultiplexer circuit (i.e., replacing diplexer 376) connected to coupler 373.

Sensing circuit 30*a* may include various electrical components operable to facilitate communication of an input signal 3*a* received by coupler 373. For example, sensing circuit 30*a* may include a forward error correction (FEC) circuit 375 connected to a source decoder 377. FEC circuit 375 and source decoder 377 are connected between demodulator 360 and control logic 32. FEC circuit 375 is used to correct errors in input data from input signal 3*a*.

Coupler 373 may transmit output signals 2*a* received from port F2. Output signal comprises information relative to an electrical signal parameter (e.g., an RF signal power level) of an electrical signal flowing through connector 100. Coupler 373 may facilitate the dispatch of information pertaining to an electrical signal parameter (e.g., an RF signal power level) of an electrical signal flowing through connector 100 and sensed by a coupler 373 and power sensor 31*e* of a sensing circuit 30*a* and reportable as information relative to signal level troubleshooting such as discovering interference in a transmission system, determining PIM in a transmission system, etc. For example, the sensing circuit 30*a* may be in electrical communication with the center conductor contact 80 through coupler 373. Sensed electrical signal parameter information may accordingly be passed as an output signal 2*a* from the sensing circuit 30*a* of the first spacer 40 through coupler 373. The outputted signal(s) 2*a* can then travel outside of the connector 100. Hence, the reported parameter of an electrical signal may be transmitted via output signal(s) 2*a* through coupler 373 and may be accessed at a location outside of the connector 100. Coupler 373 may comprise a wireless transmitter capable of transmitting electromagnet signals, such as, radiowaves, Wi-fi transmissions, RFID transmissions, satellite transmissions, BLUETOOTH™ (open wireless technology standard) wireless transmissions, and the like. Accordingly, an output signal, such as wireless output signal 2*b* depicted in FIG. 5, may be reported from the sensing circuit 30*a* and dispatched through coupler 373 to a device outside of the connector 100, such as a wireless reader 400*b* located a few feet from the connector 100. Coupler 373 is configured to facilitate conveyance of the electrical signal parameter to a location outside of the connector body 50 so that a user can obtain the reported information and use the reported information to determine PIM in a transmission system. Sensing circuit 30*a* additionally comprises a source coder 379 and an up-convertor 381 for conditioning the output signal 2*a*.

Figure 5:
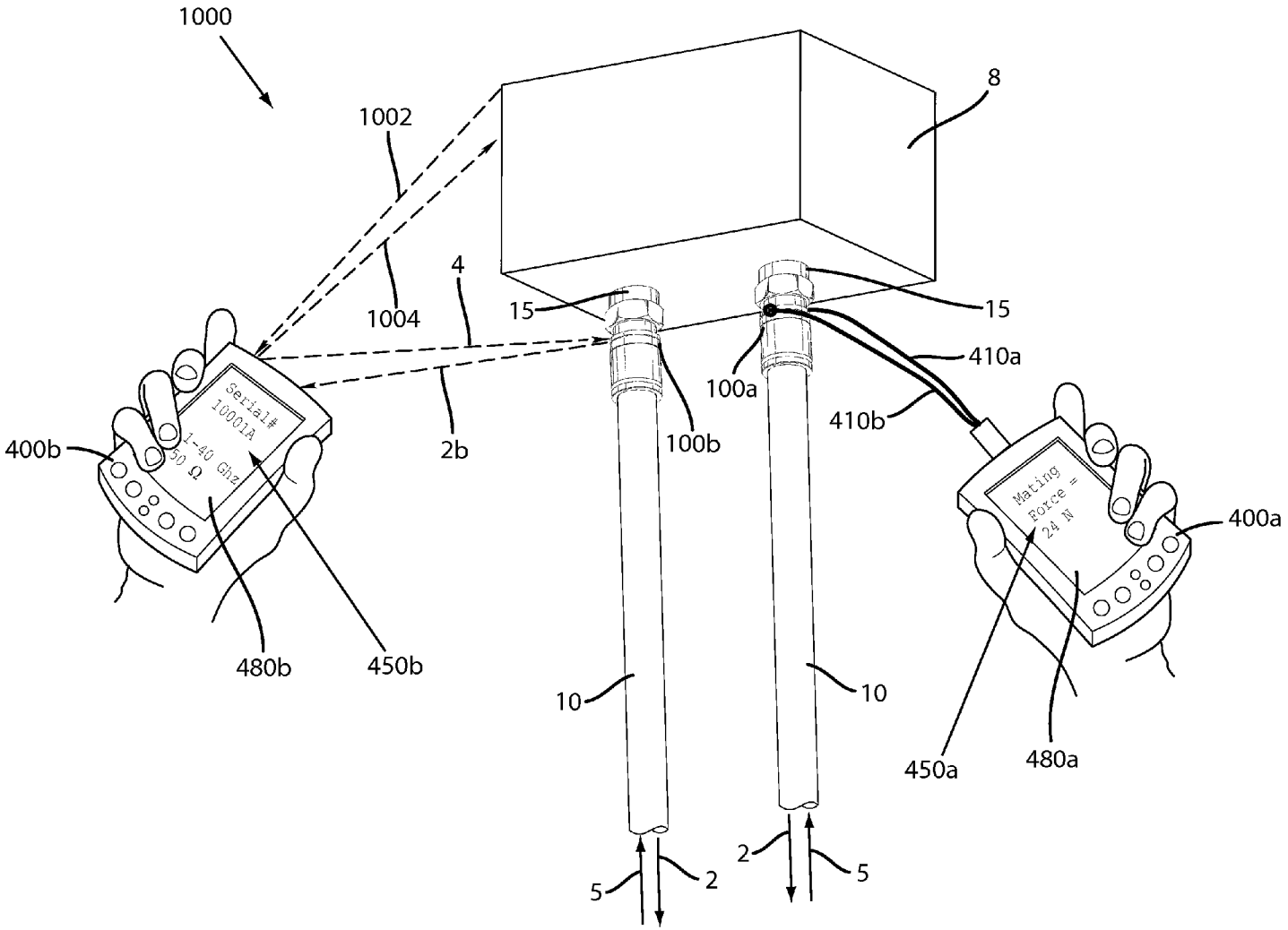
FIG. 5 depicts a schematic view of an embodiment of a coaxial cable connector connection system, in accordance with the present invention.

Referring further to FIGS. 1-4B and with additional reference to FIG. 5 embodiments of a coaxial cable connection system 1000 may include a physical parameter status/electrical parameter reader 400 located externally to the connector 100. The reader 400 is configured to receive, via the status output component 20 (of FIG. 4A) or directional coupler 373 (of FIG. 4B), information from the sensing circuit 30. Another embodiment of a reader 400 may be an output signal 2 monitoring device located somewhere along the cable line to which the connector 100 is attached. For example, a physical parameter status may be reported through an output component 20 in electrical communication with the center conductor of the cable 10. Then the reported status may be monitored by an individual or a computer-directed program at the cable-line head end to evaluate the reported physical parameter status and help maintain connection performance. The connector 100 may ascertain connection conditions and may transmit physical parameter status information or an electrical parameter of an electrical signal automatically at regulated time intervals, or may transmit information when polled from a central location, such as the head end (CMTS), via a network using existing technology such as modems, taps, and cable boxes. A reader 400 may be located on a satellite operable to transmit signals to a connector 100. Alternatively, service technicians could request a status report and read sensed or stored physical parameter status information (or electrical parameter information) onsite at or near a connection location, through wireless hand devices, such as a reader 400*b*, or by direct terminal connections with the connector 100, such as by a reader 400*a*. Moreover, a service technician could monitor connection performance via transmission over the cable line through other common coaxial communication implements such as taps, set tops, and boxes.

Operation of a connector 100 can be altered through transmitted input signals 5 from the network or by signals transmitted onsite near a connector 100 connection. For example, a service technician may transmit a wireless input signal 4 from a reader 400*b*, wherein the wireless input signal 4 includes a command operable to initiate or modify functionality of the connector 100. The command of the wireless input signal 4 may be a directive that triggers governing protocol of the control logic unit 32 to execute particular logic operations that control connector 100 functionality. The service technician, for instance, may utilize the reader 400*b* to command the connector 100, through a wireless input component 300, to presently sense a connection condition 1*c* related to current moisture presence, if any, of the connection. Thus the control logic unit 32 may communicate with the humidity sensor 31*c*, which in turn may sense a moisture condition 1*c* of the connection. The sensing circuit 30 could then report a real-time physical parameter status related to moisture presence of the connection by dispatching an output signal 2 through an output component 20 and back to the reader 400*b* located outside of the connector 100. The service technician, following receipt of the moisture monitoring report, could then transmit another input signal 4 communicating a command for the connector 100 to sense and report physical parameter status related to moisture content twice a day at regular intervals for the next six months. Later, an input signal 5 originating from the head end may be received through an input component 300 in electrical communication with the center conductor contact 80 to modify the earlier command from the service technician. The later-received input signal 5 may include a command for the connector 100 to only report a physical parameter status pertaining to moisture once a day and then store the other moisture status report in memory 33 for a period of 20 days.

Figure 6:
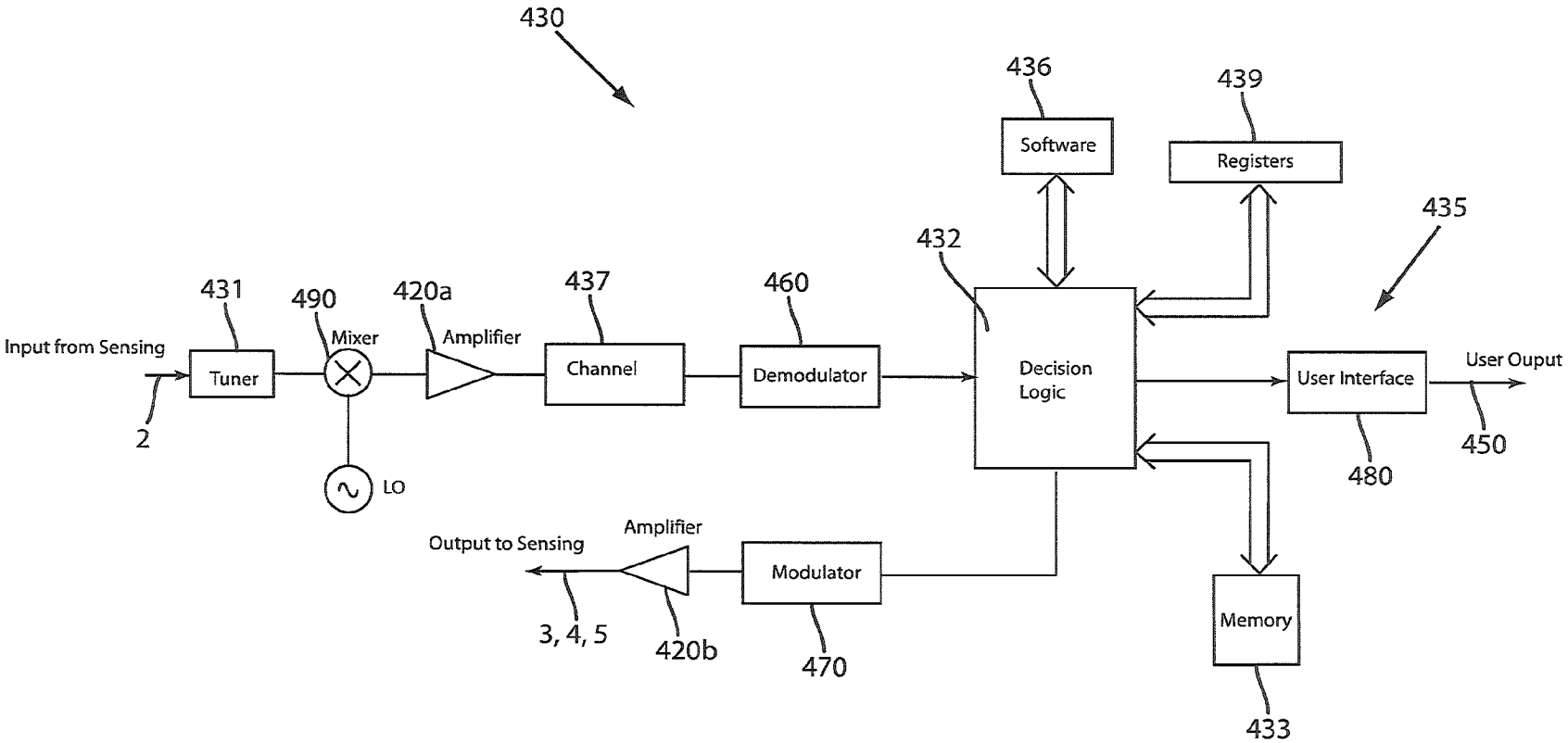
FIG. 6 depicts a schematic view of an embodiment of a reader circuit, in accordance with the present invention.

With continued reference to the drawings, FIG. 6 depicts a schematic view of an embodiment of a reader circuit 430. Those in the art should appreciate that the overall configuration of the depicted reader circuit 430 is exemplary. The various operable components included in the depicted reader circuit 430 are also included for exemplary purposes. Other reader circuit configurations including other components may be operably employed to facilitate communication of a reader, such as a reader 400, with a connector 100. A reader circuit 430 may include a tuner 431 configured to modify a received signal input, such as an output signal 2 transmitted from a connector 100, and convert the output signal 2 to a form suitable for possible further signal processing. The reader circuit 430 may also include a mixer 490 configured to alter, if necessary, the carrier frequency of the received output signal 2. An amplifier 420*a* may be included in a reader circuit 430 to modify the signal strength of the received output signal 2. The reader circuit 430 may further include a channel decoder 437 to decode, if necessary, the received output signal 2 so that applicable physical parameter status information may be retrieved. Still further, the reader circuit 430 may include a demodulator 460 in electrical communication with a decision logic unit 432. The demodulator 460 may be configured to recover information content from the carrier wave of the received output signal 2.

A decision logic unit 432 of an embodiment of a reader circuit 430 may include or operate with protocol to govern what, if any, actions can/should be taken with regard to the received physical parameter status output signal 2 following its electrical communication to the decision logic unit 432. The decision logic unit 432 may be a microprocessor or any other electrical component or electrical circuitry capable of processing a signal based on governing logic. A memory unit 433, may be in electrical communication with the control logic unit 432. The memory unit 433 may store information related to received output signals 2. The stored output signal 2 information may then be later communicated or processed by the decision logic unit 432 or otherwise operated on by the reader circuit 430. Furthermore the memory unit 433 may be a component or device that may store governing protocol. The reader circuit 430 may also comprise software 436 operable with the decision logic unit 432. The software 433 may comprise governing protocol. Stored protocol information, such as software 433, that may help govern decision logic operations may comprise a form of stored program architecture versatile for processing over some interval of time. The decision logic unit 432 may be in operable electrical communication with one or more registers 439. The registers 439 may be integral to the decision logic unit 432, such as microcircuitry on a microprocessor. The registers 439 generally contain and/or operate on signal information that the decision logic unit 432 may use to carry out reader circuit 430 functions, possibly according to some governing protocol. For example, the registers 439 may be switching transistors integrated on a microprocessor, and functioning as electronic "flip-flops."

A reader circuit 30 may include and/or be otherwise operable with a user interface 435 that may be in electrical communication with the decision logic unit 432 to provide user output 450. The user interface 435 is a component facilitating the communication of information to a user such as a service technician or other individual desiring to acquire user output 450, such as visual or audible outputs. For example, as depicted in FIG. 5, the user interface 435 may be an LCD screen 480 of a reader 400. The LCD screen 480 may interface with a user by displaying user output 450 in the form of visual depictions of determined physical parameter status corresponding to a received output signal 2. For instance, a service technician may utilize a reader 400*a* to communicate with a connector 100*a* and demand a physical parameter status applicable to connection tightness. Once a condition, such as connection tightness condition 1*a* is determined by the sensing circuit 30 of the connector 100*a*, then a corresponding output signal 2 may be transmitted via the output component 20 of the connector 100*a* through a wire lead 410*a* and/or 410*b* to the reader 400*a*.

A reader 400 utilizes information pertaining to a reported physical parameter status to provide a user output 450 viewable on a user interface 480. For instance, following reception of the output signal 2 by the reader 400*a*, the reader circuit 430 may process the information of the output signal 2 and communicate it to the user interface LCD screen 480 as user output 450 in the form of a visual depiction of a physical parameter status indicating that the current mating force of the connection of the connector 100*a* is 24 Newtons. Similarly, a wireless reader 400*b* may receive a wireless output signal transmission 2*b* and facilitate the provision of a user output 450 in the form of a visual depiction of a physical parameter status indicating that the connector 100*b* has a serial number 10001A and is specified to operate for cable communications between 1-40 gigahertz and up to 50 ohms. Those in the art should recognize that other user interface components such as speakers, buzzers, beeps, LEDs, lights, and other like means may be provided to communicate information to a user. For instance, an operator at a cable-line head end may hear a beep or other audible noise, when a reader 400, such as a desktop computer reader embodiment, receives an output signal 2 from a connector 100 (possibly provided at a predetermined time interval) and the desktop computer reader 400 determines that the information corresponding to the received output signal 2 renders a physical parameter status that is not within acceptable performance standards. Thus the operator, once alerted by the user output 450 beep to the unacceptable connection performance condition, may take steps to further investigate the applicable connector 100.

Communication between a reader 400 and a connector 100 may be facilitated by transmitting input signals 3, 4, 5 from a reader circuit 430. The reader circuit 430 may include a signal modulator 470 in electrical communication with the decision logic unit 432. The modulator 470 may be configured to vary the periodic waveform of an input signal 3, 4, 5 to be transmitted by the reader circuit 430. The strength of the input signal 3, 4, 5 may be modified by an amplifier 420*b* prior to transmission. Ultimately the input signal 3, 4, 5 from the reader circuit 430 is transmitted to an input component 300 in electrical communication with a sensing circuit 30 of a connector 100. Those in the art should appreciate that the input component 300 may be a part of the sensing circuit 30. For example the input component 300 may be an initial lead, trace, wire, or other electrical conduit leading from a signal entrance location of a connector 100 to the sensing circuit 30.

A coaxial cable connector connection system 1000 may include a reader 400 that is communicatively operable with devices other than a connector 100. The other devices may have greater memory storage capacity or processor capabilities than the connector 100 and may enhance communication of physical parameter status by the connector 100. For example, a reader 400 may also be configured to communicate with a coaxial communications device such as a receiving box 8. The receiving box 8, or other communications device, may include means for electromagnetic communication exchange with the reader 400. Moreover, the receiving box 8, may also include means for receiving and then processing and/or storing an output signal 2 from a connector 100, such as along a cable line. In a sense, the communications device, such as a receiving box 8, may be configured to function as a reader 400 being able to communicate with a connector 100. Hence, the reader-like communications device, such as a receiving box 8, can communicate with the connector 100 via transmissions received through an input component 300 connected to the center conductor contact 80 of the connector. Additionally, embodiments of a reader-like device, such as a receiving box 8, may then communicate information received from a connector 100 to another reader 400. For instance, an output signal 2 may be transmitted from a connector 100 along a cable line to a reader-like receiving box 8 to which the connector is communicatively connected. Then the reader-like receiving box 8 may store physical parameter status information pertaining to the received output signal 2. Later a user may operate a reader 400 and communicate with the reader-like receiving box 8 sending a transmission 1004 to obtain stored physical parameter status information via a return transmission 1002.

Alternatively, a user may operate a reader 400 to command a reader-like device, such as a receiving box 8 communicatively connected to a connector 100, to further command the connector 100 to report a physical parameter status receivable by the reader-like receiving box 8 in the form of an output signal 2. Thus by sending a command transmission 1004 to the reader-like receiving box 8, a communicatively connected connector 100 may in turn provide an output signal 2 including physical parameter status information that may be forwarded by the reader-like receiving box 8 to the reader 400 via a transmission 1002. The coaxial communication device, such as a receiving box 8, may have an interface, such as an RF port 15, to which the connector 100 is coupled to form a connection therewith.

A coaxial cable connector 100 comprises means for monitoring a physical parameter status of a connection of the connector 100. The physical parameter status monitoring means may include internal circuitry that may sense connection conditions, store data, and/or determine monitorable variables of physical parameter status through operation of a physical parameter status sensing circuit 30. A sensing circuit 30 may be integrated onto typical coaxial cable connector components. The sensing circuit 30 may be located on existing connector structures, such as on a face 42 of a first spacer 40 of the connector 100. The physical parameter status sensing circuit 30 is configured to sense a condition of the connector 100 when the connector 100 is connected with an interface of a common coaxial cable communications device, such as RF interface port 15 of receiving box 8 (see FIG. 5).

A coaxial cable connector 100 comprises means for reporting the physical parameter status of the connection of the connector 100 to another device having a connection interface, such as an RF port. The means for reporting the physical parameter status of the connection of the connector 100 may be integrated onto existing connector components. The physical parameter status reporting means are configured to report the physical parameter status to a location outside of a connector body 50 of the connector 100. The physical parameter status reporting means may include a status output component 20 positioned within the connector body 50 and configured to facilitate the dispatch of information pertaining to a connection condition 1 sensed by a sensor 30 of a sensing circuit 30 and reportable as a physical parameter status of the connection of a connector 100. Sensed physical parameter status information may be passed as an output signal 2 from the sensing circuit 30 located on a connector component, such as first spacer 40, through the output component 20, comprising a trace or other conductive element electrically linked to the center conductor contact 80. The outputted signal(s) 2 can then travel outside of the connector 100 along the cable line (see FIG. 5) corresponding to the cable connection applicable to the connector 100.

Alternatively, the connection performance reporting means may include an output component 20 configured to facilitate wired transmission of an output signal 2 to a location outside of the connector 100. The physical parameter status reporting means may include a status output component 20 positioned within the connector body 50 and configured to facilitate the dispatch of information pertaining to a connection condition 1 sensed by a sensor 31 of a sensing circuit 30 and reportable as a physical parameter status of the connection of a connector 100. Sensed physical parameter status information may be passed as an output signal 2 from the sensing circuit 30 located on a connector component, such as first spacer 40, through the output component 20, comprising a trace or other conductive element that is physically accessible by a communications device, such as a wire lead 410 from a reader 400*a* (see FIG. 5). The sensing circuit 30 may be electrically linked by traces, leads, wires, or other electrical conduits located within a connector 100*a* to electrically connect an external communications device, such as the handheld reader 400*a*. An output signal 2 from the sensing circuit 30 may dispatch through the output component 20 to a reader 400*a* located outside of the connector, wherein the reader 400*a* receives the output signal 2 through a wire lead 410 in electrical contact with the connector 100*a*. The handheld reader 400*a* may be in physical and electrical communication with the connector 100 through the wire lead 410 contacting the connector 10.

As a still further alternative, the physical parameter status reporting means may include an output component 20 configured to facilitate wireless transmission of an output signal 2 to a location outside of the connector 100. For example the output component 20 may comprise a wireless transmitter capable of transmitting electromagnet signals, such as, radiowaves, Wi-fi transmissions, RFID transmissions, satellite transmissions, BLUETOOTH™ (open wireless technology standard) wireless transmissions, and the like. Accordingly, an output signal, such as wireless output signal 2*b* depicted in FIG. 5, may be reported from the sensing circuit 30 and dispatched through the output component 20 to a device outside of the connector 100, such as a wireless reader 400*b*.

A sensing circuit 30 may be calibrated. Calibration may be efficiently performed for a multitude of sensing circuits similarly positioned in connectors 100 having substantially the same configuration. For example, because a sensing circuit 30 may be integrated onto a typical component of a connector 100, the size and material make-up of the various components of the plurality of connectors 100 can be substantially similar. As a result, a multitude of connectors 100 may be batch-fabricated and assembled to each have substantially similar structure and physical geometry. Accordingly, calibration of a sensing circuit 30 may be approximately similar for all similar connectors fabricated in a batch. Furthermore, the sensing circuit 30 of each of a plurality of connectors 100 may be substantially similar in electrical layout and function. Therefore, the electrical functionality of each similar sensing circuit 30 may predictably behave in accordance to similar connector 100 configurations having substantially the same design, component make-up, and assembled geometry. Accordingly, the sensing circuit 30 of each connector 100 that is similarly mass-fabricated, having substantially the same design, component make-up, and assembled configuration, may not need to be individually calibrated. Calibration may be done for an entire similar product line of connectors 100. Periodic testing can then assure that the calibration is still accurate for the line. Moreover, because the sensing circuit 30 may be integrated into existing connector components, the connector 100 can be assembled in substantially the same way as typical connectors and requires very little, if any, mass assembly modifications.

Various connection conditions 1 pertinent to the connection of a connector 100 may be determinable by a sensing circuit 30 because of the position of various sensors 31 within the connector 100. Sensor 31 location may correlate with the functionality of the various portions or components of the connector 100. For example, a sensor 31*a* configured to detect a connection tightness condition 1*a* may be positioned near a connector 100 component that contacts a portion of a mated connection device, such as an RF interface port 15 of receiving box 8 (see FIG. 5); while a humidity sensor 31*c* configured to detect a moisture presence condition 1*c* may be positioned in a portion of the connector 100 that is proximate the attached coaxial cable 10 that may have moisture included therein, which may enter the connection.

The various components of a connector 100 assembly create a sandwich of parts, similar to a sandwich of parts existent in typical coaxial cable connectors. Thus, assembly of a connector 100 having an integral sensing circuit 30 may be no different from or substantially similar to the assembly of a common coaxial cable connector that has no sensing circuit 30 built in. The substantial similarity between individual connector 100 assemblies can be very predictable due to mass fabrication of various connector 100 components. As such, the sensing circuits 30 of each similarly configured connector 100 may not be adjusted or calibrated individually, since each connector 100, when assembled, should have substantially similar dimension and configuration. Calibration of one or a few connectors 100 of a mass-fabricated batch may be sufficient to render adequate assurance of similar functionality of the other untested/uncalibrated connectors 100 similarly configured and mass produced.

Referring to FIGS. 1-6 a coaxial cable connector physical parameter status ascertainment method is described. A coaxial cable connector 100 is provided. The coaxial cable connector 100 has a connector body 50. Moreover, a sensing circuit 30 is provided, wherein the sensing circuit 30 is housed within the connector body 50 of the connector 100. The sensing circuit has a sensor 31 configured to sense a physical parameter of the connector 100 when connected. In addition, a physical parameter status output component 20 is provided within the connector body 50. The status output component 20 is in communication with the sensing circuit 30 to receive physical parameter status information. Further physical parameter status ascertainment methodology includes connecting the connector 100 to an interface, such as RF port 15, of another connection device, such as a receiving box 8, to form a connection. Once the connection is formed, physical parameter status information applicable to the connection may be reported, via the status output component 20, to facilitate conveyance of the physical parameter status of the connection to a location outside of the connector body 50.

A further connection status ascertainment step may include sensing a physical parameter status of the connector 100 connection, wherein the sensing is performed by the sensing circuit 30. In addition, reporting physical parameter status to a location outside of the connector body 50, may include communication of the status to another device, such as a handheld reader 400, so that a user can obtain the ascertained physical parameter status of the connector 100 connection.

Physical parameter status ascertainment methodology may also comprise the inclusion of an input component 300 within the connector 100. Still further, the ascertainment method may include transmitting an input signal 3, 4, 5 from a reader 400 external to the input component 300 of the connector 100 to command the connector 100 to report a physical parameter status. The input signal 5 originates from a reader 400 at a head end of a cable line to which the connector 100 is connected. The input signals 3, 4 originate from a handheld reader 400*a*, 400*b* possibly operated by a service technician located onsite near where the connector 100 is connected.

It is important that a coaxial cable connector be properly connected or mated to an interface port of a device for cable communications to be exchanged accurately. One way to help verify whether a proper connection of a coaxial cable connector is made is to determine and report mating force in the connection. Common coaxial cable connectors have been provided, whereby mating force can be determined. However, such common connectors are plagued by inefficient, costly, and impractical considerations related to design, manufacture, and use in determining mating force. Accordingly, there is a need for an improved connector for determining mating force. Various embodiments of the present invention can address the need to efficiently ascertain mating force and maintain proper physical parameter status relative to a connector connection. Additionally, it is important to determine the humidity status of the cable connector and report the presence of moisture.

Figure 7:
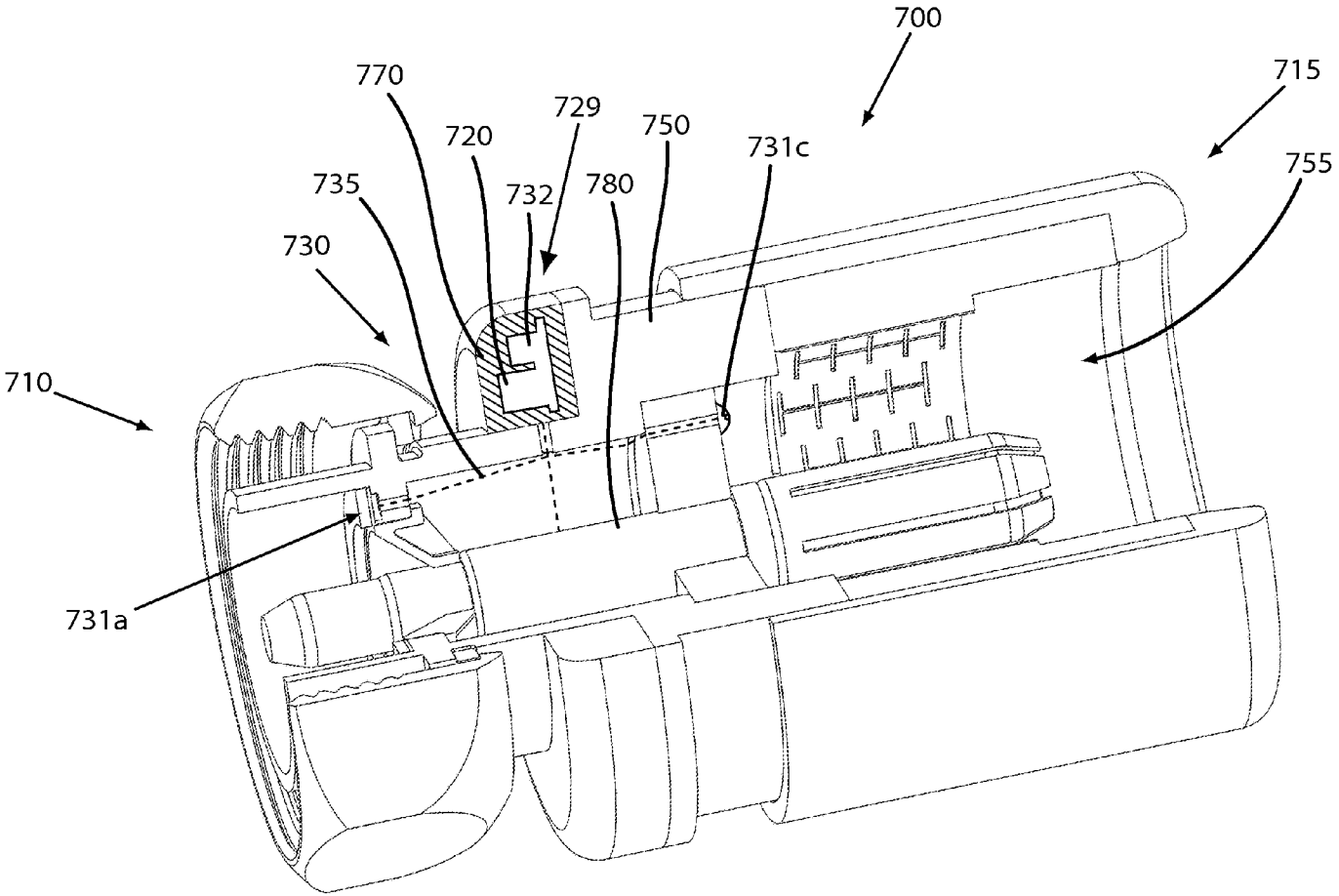
FIG. 7 depicts a side perspective cut-away view of an embodiment of a coaxial cable connector having a force sensor and a humidity sensor.

Referring to the drawings, FIG. 7 depicts a side perspective cut-away view of an embodiment of a coaxial cable connector 700 having a mating force sensor 731*a* and a humidity sensor 731*c*. The connector 700 includes port connection end 710 and a cable connection end 715. In addition, the connector 700 includes sensing circuit 730 operable with the mating force sensor 731*a* and the humidity sensor or moisture sensor 731*c*. The mating force sensor 731*a* and the humidity sensor 731*c* may be connected to a processor control logic unit 732 operable with an output transmitter 720 through leads, traces, wires, or other electrical conduits depicted as dashed lines 735. The sensing circuit electrically links the mating force sensor 731*a* and the humidity sensor 731*c* to the processor control logic unit 732 and the output transmitter 729. For instance, the electrical conduits 735 may electrically tie various components, such as the processor control logic unit 732, the sensors 731*a*, 731*c* and an inner conductor contact 780 together.

The processor control logic unit 732 and the output transmitter 720 may be housed within a weather-proof encasement 770 operable with a portion of the body 750 of the connector 700. The encasement 770 may be integral with the connector body portion 750 or may be separately joined thereto. The encasement 770 should be designed to protect the processor control logic unit 732 and the output transmitter 720 from potentially harmful or disruptive environmental conditions. The mating force sensor 731*a* and the humidity sensor 731*c* are connected via a sensing circuit 730 to the processor control logic unit 732 and the output transmitter 720.

The mating force sensor 731*a* is located at the port connection end 710 of the connector 700. When the connector 700 is mated to an interface port, such as port 15 shown in FIG. 5, the corresponding mating forces may be sensed by the mating force sensor 731*a*. For example, the mating force sensor 731*a* may comprise a transducer operable with an actuator such that when the port, such as port 15, is mated to the connector 700 the actuator is moved by the forces of the mated components causing the transducer to convert the actuation energy into a signal that is transmitted to the processor control logic unit 732. The actuator and/or transmitter of the mating force sensor 731*a* may be tuned so that stronger mating forces correspond to greater movement of the actuator and result in higher actuation energy that the transducer can send as a stronger signal. Hence, the mating force sensor 731*a* may be able to detect a variable range or mating forces.

The humidity sensor 731*c* is located within a cavity 755 of the connector 700, wherein the cavity 755 extends from the cable connection end 715 of the connector 700. The moisture sensor 731*c* may be an impedance moisture sensor configured so that the presence of water vapor or liquid water that is in contact with the sensor 731*c* hinders a time-varying electric current flowing through the humidity sensor 731*c*. The humidity sensor 731*c* is in electrical communication with the processor control logic unit 732, which can read how much impedance is existent in the electrical communication. In addition, the humidity sensor 731*c* can be tuned so that the greater the contact of the sensor with water vapor or liquid water, the greater the measurable impedance. Thus, the humidity sensor 731*c* may detect a variable range or humidity and moisture presence corresponding to an associated range of impedance thereby. Accordingly, the humidity sensor 731*c* can detect the presence of humidity within the cavity 755 when a coaxial cable, such as cable 10 depicted in FIG. 5, is connected to the cable connection end 715 of the connector 700.

Figure 8:
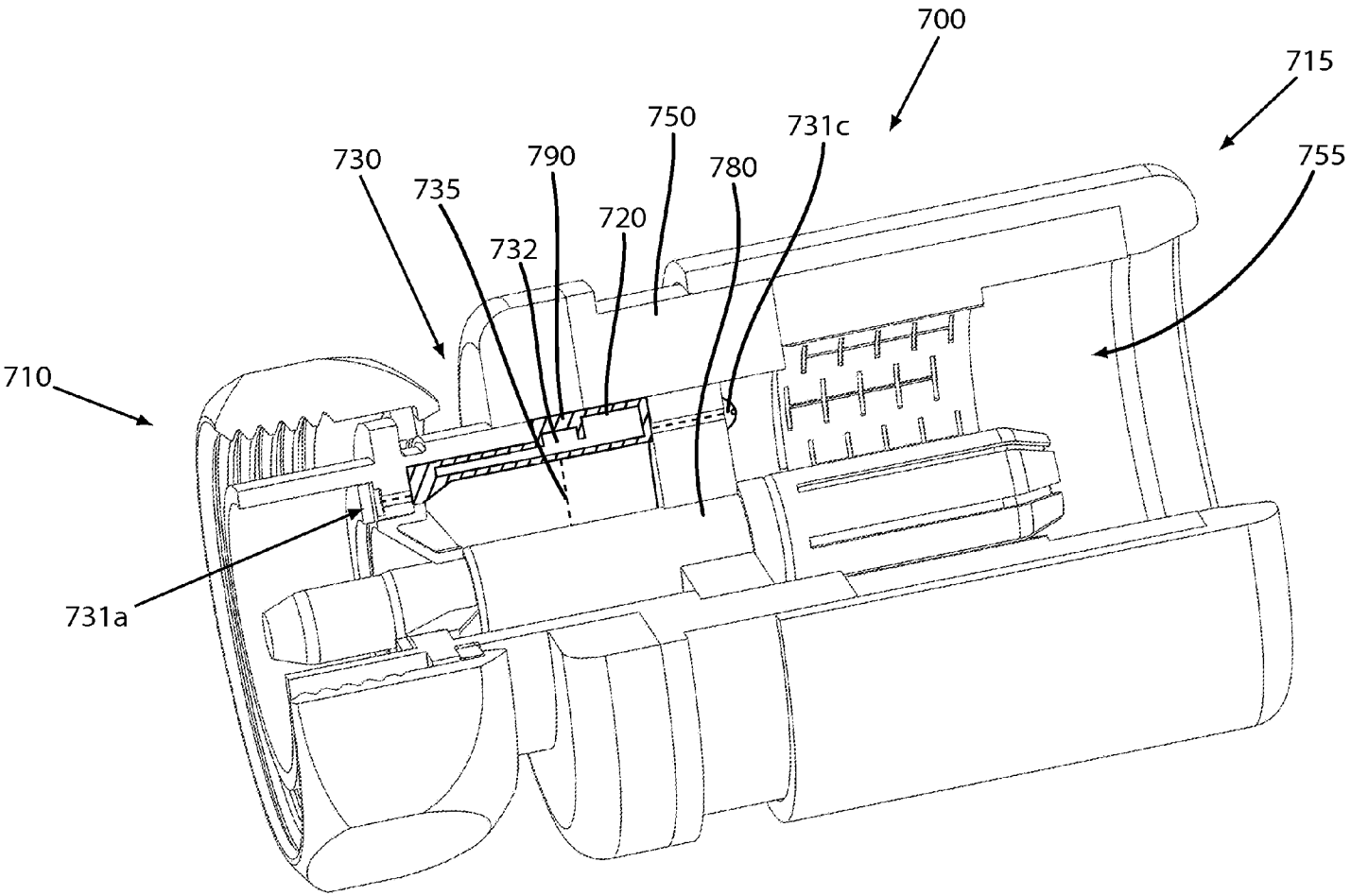
FIG. 8 depicts a side perspective cut-away view of another embodiment of a coaxial cable connector having a force sensor and a humidity sensor.

Another embodiment of a coaxial cable connector 700 having a force sensor 731*a* and a humidity sensor 731*c* is depicted in FIG. 8. The mating force sensor 731*a* and the humidity sensor 731*c* of the connector 700 shown in FIG. 8 may function the same as, or function similarly to, the mating force sensor 731*a* and the humidity sensor 731*c* of the connector 700 shown in FIG. 7. For example, the mating force sensor 731*a* and the humidity sensor 731*c* are connected via a sensing circuit 730 to the processor control logic unit 732 and the output transmitter 720. The sensing circuit 730 electrically links the mating force sensor 731*a* and the humidity sensor 731*c* to the control logic unit and the output transmitter. However, in a manner different from the embodiment of the connector 700 depicted in FIG. 7, the processor control logic unit 732 and the output transmitter 720 may be housed within an EMI/RFI shielding/absorbing encasement 790 in the embodiment of a connector 700 depicted in FIG. 8. The EMI/RFI shielding/absorbing encasement 790 may be located radially within a body portion 750 of the connector 700. The processor control logic unit 732 and the output transmitter 720 may be connected to through leads, traces, wires, or other electrical conduits depicted as dashed lines 735 to the mating force sensor 731*a* and the humidity sensor 731*c*. The electrical conduits 735 may electrically link various components, such as the processor control logic unit 732, the sensors 731*a*, 731*c* and an inner conductor contact 780.

Power for the sensing circuit 730, processor control unit 732, output transmitter 720, mating force sensor 731*a*, and/or the humidity sensor 731*c* of embodiments of the connector 700 depicted in FIGS. 7 or 8 may be provided through electrical contact with the inner conductor contact 780. For example, the electrical conduits 735 connected to the inner conductor contact 780 may facilitate the ability for various connector 700 components to draw power from the cable signal(s) passing through the inner connector contact 780. In addition, electrical conduits 735 may be formed and positioned so as to make contact with grounding components of the connector 700.

The output transmitter 720, of embodiments of a connector 700 depicted in FIGS. 7-8, may propagate electromagnetic signals from the connector 700 to a source external to the connector 700. For example, the output transmitter 720 may be a radio transmitter providing signals within a particular frequency range that can be detected following emission from the connector 700. The output transmitter 720 may also be an active RFID device for sending signals to a corresponding reader external to the connector 700. In addition, the output transmitter 720 may be operably connected to the inner conductor contact 780 and may transmit signals through the inner conductor contact 780 and out of the connector 700 along the connected coaxial cable, such as cable 10 (see FIG. 5) to a location external to the connector 700.

With continued reference to FIGS. 1-8, there are numerous means by which a connector, such as connector 100 or connector 700, may ascertain whether it is appropriately tightened to an RF port, such as RF port 15, of a cable communications device. In furtherance of the above description with reference to the smart connector 100 or 700, FIGS. 9-12*b* are intended to disclose various exemplary embodiments of a smart connector 800 having connection tightness detection means. A basic sensing method may include the provision of a connector 800 having a sensing circuit, which simply monitors the typical ground or shield path of the coaxial cable connection for continuity. Any separation of the connector ground plane from the RF interface port 815 would produce an open circuit that is detectable. This method works well to detect connections that are electrically defective. However, this method may not detect connections that are electrically touching but still not tight enough. In addition, this method may not detect whether the mating forces are too strong between the connected components and the connection is too tight and possibly prone to failure.

Figure 9:
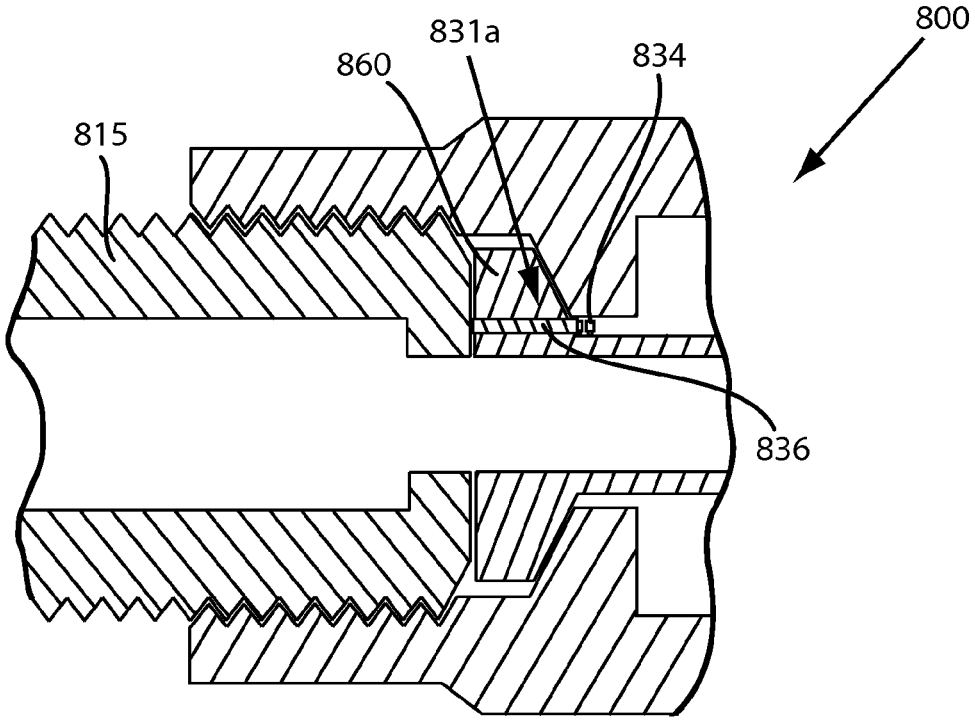
FIG. 9 depicts a partial side cross-sectional view of an embodiment a connector mated to an RF port, the connector having a mechanical connection tightness sensor, in accordance with the present invention.

Connection tightness may be detected by mechanical sensing, as shown by way of example in FIG. 9, which depicts a partial side cross-sectional view of an embodiment a connector 800 mated to an RF port 815, the connector 800 having a mechanical connection tightness sensor 831*a*. The mechanical connection tightness sensor 831*a* may comprise a movable element 836. The movable element 836 is located to contact the interface port 815 when the connector 800 is tightened thereto. For example, the movable element 836 may be a push rod located in a clearing hole positioned in a interface component 860, such as a central post having a conductive grounding surface, or other like components of the connector 800. The movable element 836, such as a push rod, may be spring biased. An electrical contact 834 may be positioned at one end of the range of motion of the moveable element 839. The electrical contact 834 and movable element 836 may comprise a micro-electro-mechanical switch in electrical communication with a sensing circuit, such as sensing circuit 30. Accordingly, if the connector 800 is properly tightened the movable element 836 of the connection tightness sensor 831*a* will be mechanically located in a position where the contact 834 is in one state (either open or closed, depending on circuit design). If the connector 800 is not tightened hard enough onto the RF interface port 815, or the connector 800 is tightened too much, then the movable element 836 may or may not (depending on circuit design) electrically interface with the contact 834 causing the contact 834 to exist in an electrical state coordinated to indicate an improper connection tightness.

Figure 10:
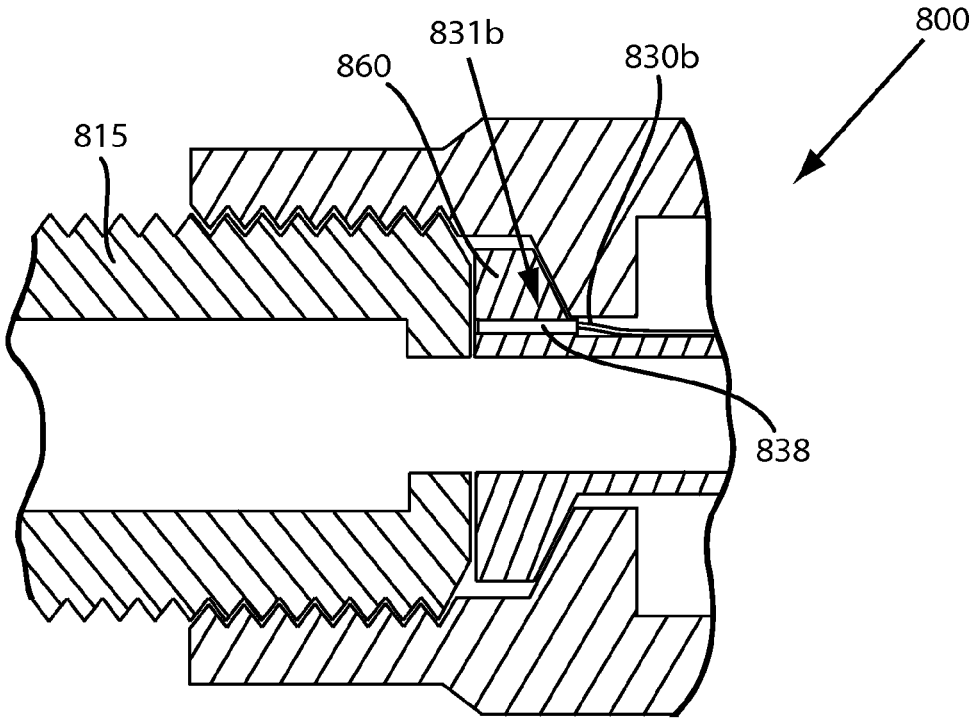
FIG. 10 depicts a partial side cross-sectional view of an embodiment a connector mated to an RF port, the connector having an electrical proximity connection tightness sensor, in accordance with the present invention.

Connection tightness may be detected by electrical proximity sensing, as shown by way of example in FIG. 10, which depicts a partial side cross-sectional view of an embodiment a connector 800 mated to an RF port 815, the connector 800 having an electrical proximity connection tightness sensor 831*b*. The electrical proximity connection tightness sensor 831*b* may comprise an electromagnetic sensory device 838, mounted in such as way as to electromagnetically detect the nearness of the connector 800 to the RF interface port 815. For example, the electromagnetic sensory device 838 may be an inductor or capacitor that may be an inductor located in a clearing hole of an interface component 860, such as a central post, of the connector 800. An electromagnetic sensory device 838 comprising an inductor may be positioned to detect the ratio of magnetic flux to any current (changes in inductance) that occurs as the connector 800 is mounted to the RF port 815. The electromagnetic sensory device 838 may be electrically coupled to leads 830*b* that run to additional sensing circuitry of the connector 800. Electrical changes due to proximity or tightness of the connection, such as changes in inductance, may be sensed by the electromagnetic sensory device 838 and interpreted by an associated sensing circuit, such as sensing circuit 30. Moreover, the electromagnet sensory device may comprise a capacitor that detects and stores an amount of electric charge (stored or separated) for a given electric potential corresponding to the proximity or tightness of the connection. Accordingly, if the connector 800 is properly tightened the electromagnetic sensory device 838 of the electrical proximity connection tightness sensor 831*b* will detect an electromagnet state that is not correlated with proper connection tightness. The correlation of proper electromagnetic state with proper connection tightness may be determined through calibration of the electrical proximity connection tightness sensor 831*b*.

Connection tightness may be detected by optical sensing, as shown by way of example in FIGS. 11A and 11B, which depict a partial side cross-sectional view of an embodiment a connector 800 mated to an RF port 815, the connector 800 having an optical connection tightness sensor 831*c*. The optical connection tightness sensor 831*c* may utilize interferometry principles to gauge the distance between the connector 800 and a mounting face 816 of an RF interface port 815. For instance, the optical connection tightness sensor 831*c* may include an emitter 833. The emitter 833 could be mounted in a portion of an interface component 860, such as interface end of a central post, so that the emitter 833 could send out emissions 835 in an angled direction toward the RF interface port 815 as it is being connected to the connector 800. The emitter 833 could be a laser diode emitter, or any other device capable of providing reflectable emissions 835. In addition, the optical connection tightness sensor 831*c* may include a receiver 837. The receiver 837 could be positioned so that it receives emissions 835 reflected off of the interface port 815. Accordingly, the receiver 837 may be positioned in the interface component 860 at an angle so that it can appropriately receive the reflected emissions 835. If the mounting face 816 of the interface port is too far from the optical connection tightness sensor 831*c*, then none, or an undetectable portion, of emissions 835 will be reflected to the receiver 837 and improper connection tightness will be indicated. Furthermore, the emitter 833 and receiver 837 may be positioned so that reflected emissions will comprise superposing (interfering) waves, which create an output wave different from the input waves; this in turn can be used to explore the differences between the input waves and those differences can be calibrated according to tightness of the connection. Hence, the when the optical connection tightness sensor 831*c* detects interfering waves of emissions 835 corresponding to accurate positioning of the RF interface port 815 with respect to the connector 800, then a properly tightened connection may be determined.

Connection tightness may be detected by strain sensing, as shown by way of example in FIGS. 12A and 12B, which depict a partial side cross-sectional view of an embodiment a connector 800 mated to an RF port 815, the connector 800 having a strain connection tightness sensor 831*d*, as connected to further electrical circuitry 832. The strain connection tightness sensor 831*d* includes a strain gauge 839. The strain gauge 839 may be mounted to a portion of an interface component 860 that contacts the RF port 815 when connected. For instance, the strain gauge 839 may be positioned on an outer surface of an interface component 860 comprising a central post of the connector 800. The strain gauge may be connected (as shown schematically in FIG. 16*a*) through leads or traces 830*d* to additional circuitry 832. The variable resistance of the strain gauge 839 may rise or fall as the interface component 860 deforms due to mating forces applied by the interface port 815 when connected. The deformity of the interface component 860 may be proportional to the mating force. Thus a range of connection tightness may be detectable by the strain connection tightness sensor 831*d*. Other embodiments of the strain connection tightness sensor 831*d* may not employ a strain gauge 839. For instance, the interface component 860 may be formed of material that has a variable bulk resistance subject to strain. The interface component 860 could then serve to sense mating force as resistance changed due to mating forces when the connector 800 is tightened to the RF port 815. The interface component 860 may be in electrical communication with additional circuitry 832 to relay changes in resistance as correlated to connection tightness. Still further embodiments of a strain connection tightness sensor may utilize an applied voltage to detect changes in strain. For example, the interface component 860 may be formed of piezoelastic/electric materials that modify applied voltage as mating forces are increased or relaxed.

Cost effectiveness may help determine what types of physical parameter status, such as connection tightness or humidity presence, are ascertainable by means operable with a connector 100, 700, 800. Moreover, physical parameter status ascertainment may include provision detection means throughout an entire connection. For example, it should be understood that the above described means of physical parameter status determination may be included in the smart connector 100, 700, 800 itself, or the physical status determination means may be included in combination with the port, such as RF interface port 15, 815, to which the connector 100, 700, 800 is connected (i.e., the RF port or an interim adapter may include sensors, such as sensors 31, 731, 831, that may be electrically coupled to a sensing circuit, such as circuit 30, of the connector 100, 700, 800, so that connection tightness may be ascertained).

Figure 13:
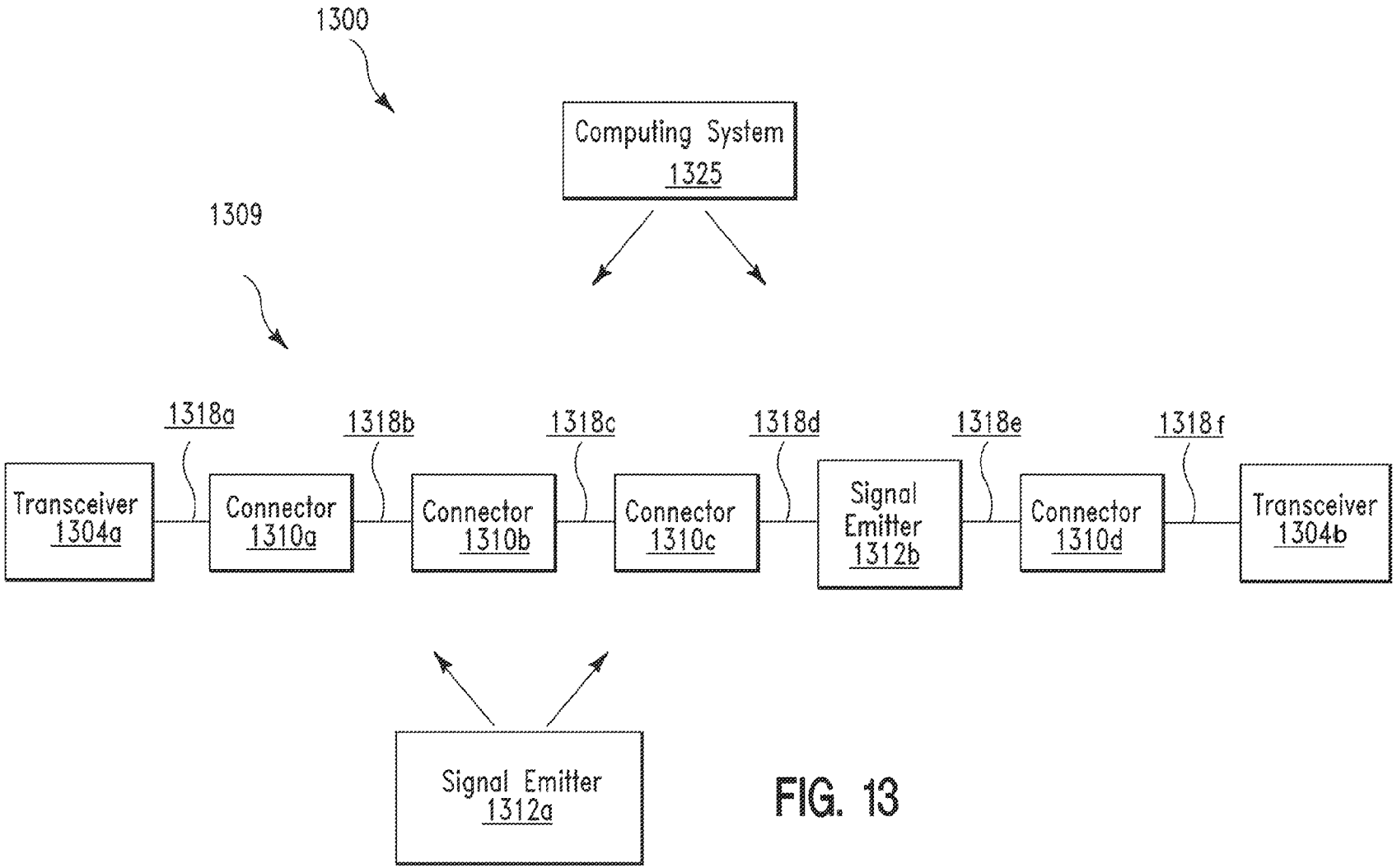
FIG. 13 depicts a block diagram of a transmission system, in accordance with embodiments of the present invention.

FIG. 13 depicts a block diagram of a transmission system 1300, in accordance with embodiments of the present invention. Transmission system 1300 comprises a transceiver 1304*a* (i.e., for transmitting and receiving an intended signal), a transceiver 1304*b* (i.e., for transmitting and receiving an intended signal), a computing system 1325, and a feed line system 1309 connected between transceiver 1304*a* and transceiver 1304*b*. Transmission system 1300 additionally comprises or is proximate to a signal emitter 1312*a* (i.e., emitting an unintended signal) and a signal emitter 1312*b* (i.e., emitting an unintended signal). Feed line system 1309 comprises coaxial cable connectors 1310*a* . . . 1310*d* connected between coaxial cable sections 1318*a* . . . 1318*f*. Feed line system 1309 may additionally comprise additional components such as diplexers, jumpers, amplifiers, surge arrestors, etc. Each of coaxial cable connectors 1310*a* . . . 1310*d* comprises (any of or all of) a connector body, a coupling circuit positioned within the connector body, an electrical signal power level detection circuit electrically connected to the coupling circuit and comprised by the connector body, an output component comprised by the connector body, and a physical parameter status sensing circuit (i.e., as described with respect to FIGS. 1-12). Transceiver 1304*a* and transceiver 1304*b* may comprise any type of transceiver capable of transmitting/receiving an intended signal including, among other things, a cellular telephone, a cable convertor box, an antenna, a two way radio, or any combination thereof. Signal emitter 1312*a* and signal emitter 1312*b* may comprise any type of signal emitter that emits an unintended signal including, among other things, a faulty contact within feed line system 1309 (e.g., within any of coaxial cable connectors 1310*a* . . . 1310*d* or components within feed line system 1309), a signal reflecting structure, etc. Signal emitter 1312*a* emits (i.e., wirelessly) an unintended signal received in feed line system 1309. Signal emitter 1312*b* emits (i.e., via a hardwire connection to feed line system 1309) an unintended signal received in feed line system 1309. Additional signal emitters similar to or the same as signal emitter 1312*a* and signal emitter 1312*b* may be present within and/or proximate to transmission system 1300. The unintended signals emitted by signal emitter 1312*a* and 1312*b* may cause a malfunction (e.g., PIM) within feed line system 1309. Coaxial cable connectors 1310*a* . . . 1310*d* in combination with computing system 1325 enable a process for discovering a specific location associated with PIM. Circuitry within coaxial cable connectors 1310*a* . . . 1310*d* sense electrical signals (i.e., from transceiver 1304*a*, transceiver 1304*b*, signal emitter 1312*a*, and/or signal emitter 1312*b*) flowing through coaxial cable connectors 1310*a* . . . 1310*d*. Signal levels (i.e., for the electrical signals) at each connector are measured and based on measured levels of the electrical signal(s), a specific location associated with a malfunction (e.g., PIM) is determined. The measured levels of the electrical signal(s) may be stored within a memory device internal to the coaxial cable connectors for future analysis. Additionally, the measured levels of the electrical signal(s) may be communicated (i.e., directly in real time or from a stored quantity within the memory device internal to the coaxial cable connectors) to computing system 1325 for analysis. Computing system 1325 receives the measured levels of the electrical signal(s) and compares the levels to each other to determine distinct power levels. The distinct power levels are used (alone or as compared to specified frequencies) to determine a malfunction (e.g., PIM) within or proximate to one of the coaxial cable connectors. For example, sudden increases in power levels, particularly increases in near band frequencies corresponding to $3^{rd}$, $5^{th}$, $7^{th}$, etc. order harmonics to a main frequency band (which could be filtered and/or have the power pick-up antenna tuned for), may indicate PIM. Compared with data (associated with signal power levels) from a same coaxial cable connector (e.g., one of coaxial cable connectors 1310*a* . . . 1310*d*) and/or other coaxial cable connectors (e.g., one of coaxial cable connectors 1310*a* . . . 1310*d*) in a chain, the data from the coaxial cable connectors closest to the PIM source may be isolated.

Figure 14:
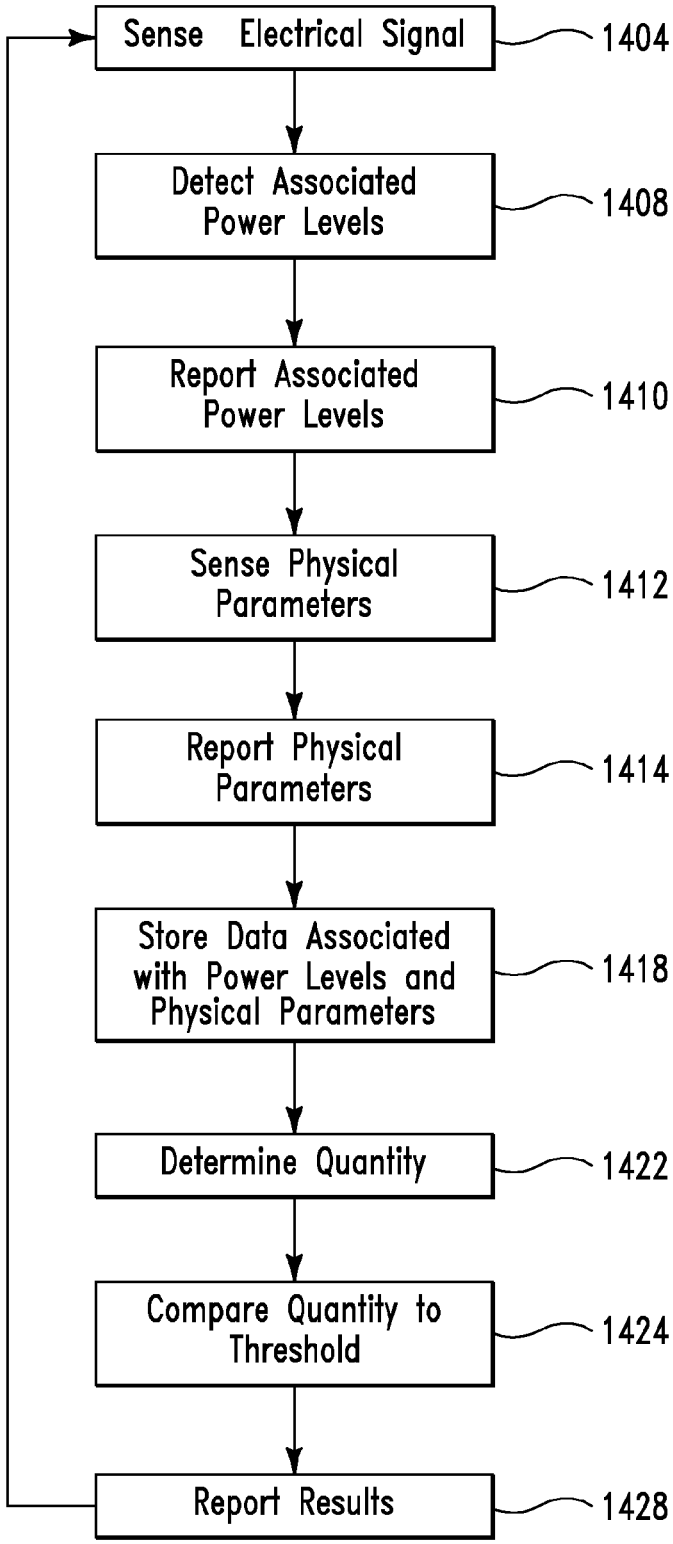
FIG. 14 illustrates a flowchart describing an algorithm used by the system of FIG. 13 for detecting a signal power level(s) associated with an electrical signal(s), in accordance with embodiments of the present invention.

FIG. 14 illustrates a flowchart describing an algorithm used by system 1300 of FIG. 13 for detecting a signal power level(s) associated with an electrical signal(s), in accordance with embodiments of the present invention. In step 1404, a coupling circuit comprised by a coaxial cable connector(s) (e.g., coaxial cable connectors 1310*a* . . . 1310*d*) senses an electrical signal flowing through the coaxial cable connector(s). In step 1408, an electrical signal power level detection circuit detects (signal) power levels (i.e., at different times) of the electrical signal (i.e., in one or more of the coaxial cable connectors). In step 1410, data describing the power levels is reported to an external device (e.g., computing system 1325 of FIG. 13) for analysis. Alternatively, the data describing the power levels may be stored within a memory device comprised by the coaxial cable connector(s) prior to reporting them to the external device. Each power level may be compared to each other to determine any distinct power levels (e.g., at harmonic intervals). If it is determined that there are distinct power levels, the distinct power levels are used to determine that a malfunction (e.g., PIM) exists at a location associated with at least one of the coaxial cable connectors located closest to the distinct power levels. Additionally, an intensity of the distinct power levels may be associated with a specified frequency additionally used to determine that the malfunction exists. In optional step 1412, a condition(s) associated with a physical parameter for a coaxial cable connector(s) connected to an associated RF port(s) is sensed by a physical parameter status sensing circuit(s) comprised by the coaxial cable connector(s). The physical parameter status sensing circuit may comprise sensors that include, among other things, a mechanical connection tightness sensor configured to detect mating forces of a connection with each associated RF port, an electrical proximity connection tightness sensor configured to detect a tightness of a connection with each associated RF port, an electrical proximity connection tightness sensor configured to detect a tightness of a connection with each associated RF port, a strain connection tightness sensor configured to detect mating forces of a connection with each associated RF port, a temperature sensor configured to sense a temperature of each coaxial cable connector. In step 1414, data describing the condition(s) (i.e., associated with the sensed physical parameter(s) for the coaxial cable connector(s)) is reported to the external device (e.g., computing system 1325 of FIG. 13) for analysis. Alternatively, the data describing the condition(s) may be stored within the memory device comprised by the coaxial cable connector(s) prior to reporting to the external device. The data describing the condition(s) may additionally (i.e., in addition to the distinct power levels determined in step 1410) be used to determine that a malfunction (e.g., PIM) exists at a location associated with at least one of the coaxial cable connectors located closest to the distinct power levels and condition(s). In step 1418, the data describing the signal power level(s) and/or the data describing the condition(s) are stored within the memory structure within the coaxial cable connector(s). In step 1422, a processing device(s) comprised by the coaxial cable connector(s) determines a quantity associated with the (signal) power level(s) and/or the distinct power levels. In step 1422, the quantity is compared to a predetermined threshold and it is determined that the quantity exceeds the predetermined threshold. In step 1428, results (i.e., indicating that the quantity exceeds the predetermined threshold) are reported to the external device (e.g., computing system 1325 of FIG. 13) and step 1404 is repeated.

Figure 15:
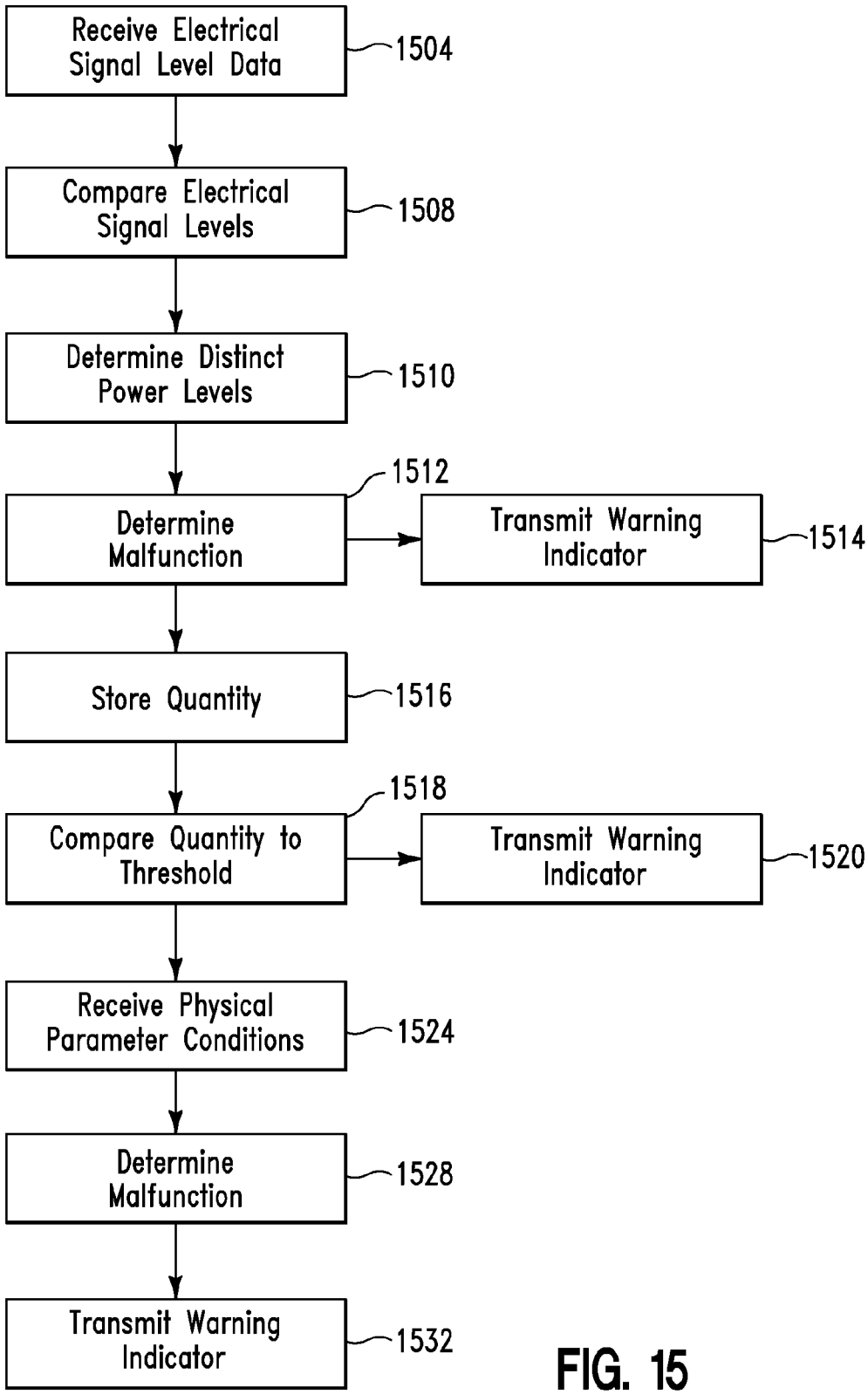
FIG. 15 illustrates a flowchart describing an algorithm used by the system of FIG. 13 for receiving and analyzing a detected signal power level(s) associated with an electrical signal(s), in accordance with embodiments of the present invention.

FIG. 15 illustrates a flowchart describing an algorithm used by system 1300 of FIG. 13 for receiving and analyzing a detected signal power level(s) associated with an electrical signal(s), in accordance with embodiments of the present invention. In step 1504, data describing the detected signal power levels are received by an external device (e.g., computing system 1325 of FIG. 13) from the electrical signal power level detection circuit(s) detecting (signal) power levels (i.e., at different times) of the electrical signal (i.e., in one or more of the coaxial cable connectors) as described with reference to FIG. 13. In step 1508, the external device compares each of the power levels to each other. In step 1510, the external device (i.e., using results of the comparing process of step 1508) determines if any distinct power levels (e.g., at harmonic intervals) exist. If it is determined that distinct power levels exist, then in step 1512, the external device determines (i.e., using the distinct power levels) that a malfunction may (e.g., PIM) exist at a location associated with at least one of the coaxial cable connectors located closest to the distinct power levels. Additionally, an intensity of the distinct power levels may be associated with a specified frequency additionally used to determine that the malfunction exists. In step 1514, the external device transmits a warning indicator (i.e., to a user via the external device, an additional device, etc) indicating that the malfunction may be present. The warning indicator may comprise, among other things, an audible sound, a viewable indicator (e.g., a warning light, a computer generated image, etc), etc. In step 1516, the external device determines a quantity associated with the (signal) power level(s) and/or the distinct power levels. In step 1518, the external device compares the quantity to a predetermined threshold quantity and determines that the quantity exceeds the predetermined threshold. Results of the comparison process of step 1422 indicate that a malfunction may (e.g., PIM) exist at a location associated with at least one of the coaxial cable connectors. In step 1520, the external device transmits a warning indicator (i.e., to a user via the external device, an additional device, etc) indicating that the malfunction may be present. In step 1524, the external device receives (i.e., from a physical parameter status sensing circuit(s) comprised by the coaxial cable connector(s)) data indicating a condition(s) associated with a physical parameter for the coaxial cable connector(s). In step 1528, the data indicating the condition(s) in combination with the results of steps 1510 and 1518 is used to determine a malfunction is present (e.g., PIM) at a location associated with at least one of the coaxial cable connectors. In step 1532, the external device transmits a warning indicator (i.e., to a user via the external device, an additional device, etc) indicating that the malfunction is present.

Figure 16:
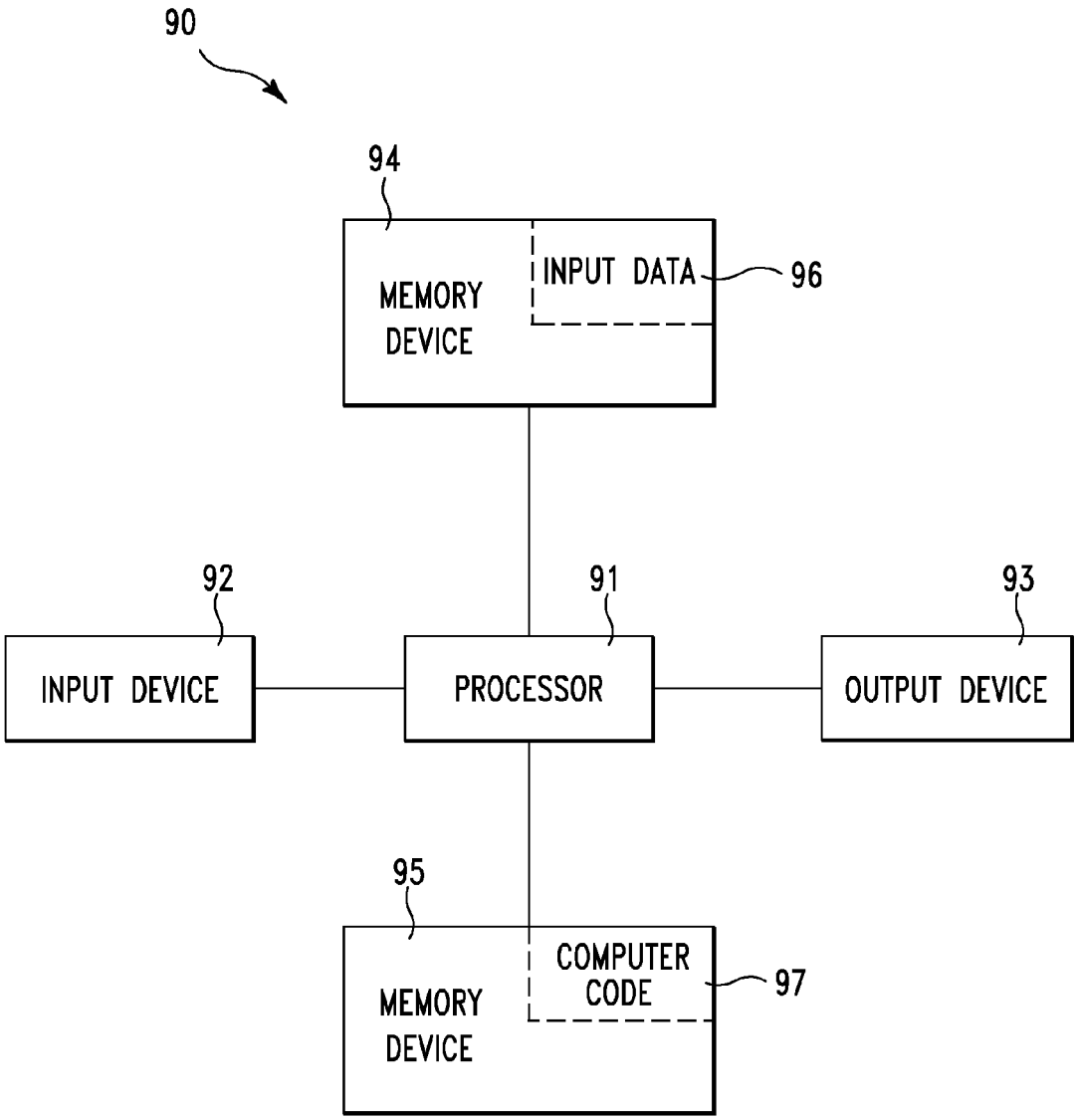
FIG. 16 illustrates a computer apparatus used for detecting and analyzing a signal power level(s), in accordance with embodiments of the present invention.

FIG. 16 illustrates a computer apparatus 90 (e.g., computing system 1325 of FIG. 13) used for detecting and analyzing a signal power level(s), in accordance with embodiments of the present invention. The computer system 90 comprises a processor 91, an input device 92 coupled to the processor 91, an output device 93 coupled to the processor 91, and memory devices 94 and 95 each coupled to the processor 91. The input device 92 may be, inter alia, a keyboard, a software application, a mouse, etc. The output device 93 may be, inter alia, a printer, a plotter, a computer screen, a magnetic tape, a removable hard disk, a floppy disk, a software application, etc. The memory devices 94 and 95 may be, inter alia, a hard disk, a floppy disk, a magnetic tape, an optical storage such as a compact disc (CD) or a digital video disc (DVD), a dynamic random access memory (DRAM), a read-only memory (ROM), etc. The memory device 95 includes a computer code 97. The computer code 97 includes algorithms (e.g., the algorithms of FIGS. 14-15) for detecting and analyzing a signal power level(s). The processor 91 executes the computer code 97. The memory device 94 includes input data 96. The input data 96 includes input required by the computer code 97. The output device 93 displays output from the computer code 97. Either or both memory devices 94 and 95 (or one or more additional memory devices not shown in FIG. 16) may comprise the algorithm of FIGS. 14-15 and may be used as a computer usable medium (or a computer readable medium or a program storage device) having a computer readable program code embodied therein and/or having other data stored therein, wherein the computer readable program code comprises the computer code 97. Generally, a computer program product (or, alternatively, an article of manufacture) of the computer system 90 may comprise said computer usable medium (or said program storage device).

While FIG. 16 shows the computer system 90 as a particular configuration of hardware and software, any configuration of hardware and software, as would be known to a person of ordinary skill in the art, may be utilized for the purposes stated supra in conjunction with the particular computer system 90 of FIG. 16. For example, the memory devices 94 and 95 may be portions of a single memory device rather than separate memory devices.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A signal level detection method comprising:

providing a transmission system comprising a signal receiving device, a signal emitting source and a feed line system connected between said signal receiving device and said signal emitting source, wherein said feed line system comprises a plurality of coaxial cable connectors connected between a plurality of coaxial cable sections, wherein each coaxial cable connector of said coaxial cable connectors comprises a connector body, a coupling circuit positioned within the connector body, an electrical signal power level detection circuit electrically connected to said coupling circuit and comprised by the connector body, and an output component comprised by the connector body, and wherein said output component is in communication with said electrical parameter sensing circuit;

sensing, by at least one said coupling circuit, an electrical signal flowing through at least one associated coaxial cable connector of said plurality of coaxial cable connectors; and detecting, by at least one said electrical signal power level detection circuit, a plurality of associated power levels of said electrical signal flowing through said at least one associated coaxial cable connector.

2. The method of claim 1, further comprising:

reporting said plurality of associated power levels, via at least one said output component, to communicate said plurality of associated power levels to a location external to each said connector body.

3. The method of claim 2, wherein each power level of said plurality of associated power levels is compared to each other power level of said plurality of associated power levels to determine if there are distinct power levels of said plurality of associated power levels.

4. The method of claim 3, wherein each said power level of said power plurality of associated power levels is associated with a single coaxial cable connector of said plurality of coaxial cable connectors.

5. The method of claim 3, wherein each said power level of said power plurality of associated power levels is associated with a different coaxial cable connector of said plurality of coaxial cable connectors.

6. The method of claim 3, wherein it is determined that there are distinct power levels, and wherein said distinct power levels are used to determine that passive intermodulation (PIM) exists at a location associated with at least one coaxial cable connector of said plurality of coaxial cable connectors or a location associated with said feed system.

7. The method of claim 6, wherein an intensity of each distinct power level of said distinct power levels is compared to an intensity of each other distinct power level of said distinct power levels to determine a specified intensity, wherein said specified intensity is associated with a specified frequency, and wherein said specified frequency is additionally used to determine that said PIM exists.

8. The method of claim 3, wherein said coaxial cable connectors are connected to RF ports, wherein each said coaxial cable connector of said coaxial cable connectors additionally comprises a physical parameter status sensing circuit comprised by the connector body, and wherein the output component is in electrical communication with the physical parameter status sensing circuit, and wherein said method further comprises:

sensing, by at least one said physical parameter status sensing circuit, a condition associated with said at least one associated coaxial cable connector connected to an associated RF port.

9. The method of claim 8, further comprising:

reporting said condition, via at least one said output component, to communicate each said condition to a location external to each said connector body.

10. The method of claim 9, wherein each said condition is associated with a single coaxial cable connector of said plurality of coaxial cable connectors.

11. The method of claim 9, wherein each said condition is associated with a different coaxial cable connector of said plurality of coaxial cable connectors.

12. The method of claim 9, wherein it is determined that there are distinct power levels, and wherein each said condition and said distinct power levels are used to determine that passive intermodulation (PIM) exists at a location associated with at least one coaxial cable connector of said plurality of coaxial cable connectors or a location associated with said feed system.

13. The method of claim 8, wherein each said physical parameter status sensing circuit comprises a sensor selected from the group consisting of a mechanical connection tightness sensor configured to detect mating forces of a connection with each said associated RF port, an electrical proximity connection tightness sensor configured to detect a tightness of a connection with each said associated RF port, an electrical proximity connection tightness sensor configured to detect a tightness of a connection with each said associated RF port, a strain connection tightness sensor configured to detect mating forces of a connection with each said associated RF port, and a temperature sensor configured to sense a temperature of each associated coaxial cable connectors of said coaxial cable connectors.

14. The method of claim 8, wherein each said physical parameter status sensing is positioned within an associated said connector body.

15. The method of claim 8, wherein each said physical parameter status sensing is positioned external to and mechanically attached to an associated said connector body.

16. The method of claim 1, wherein each said coaxial cable connector further comprises a memory structure and a processing device in communication with said memory structure, and wherein said method further comprises:

storing, by at least one said memory structure, at least one associated power level of said plurality of associated power levels;

determining, by said processing device, a quantity associated with said at least one associated power level;

comparing, by said processing device, said quantity to a predetermined threshold;

determining, by said computer processor, that said quantity exceeds said predetermined threshold; and reporting based on said determining that said quantity exceeds said predetermined threshold, via at least one said output component, to communicate said at least one associated power level to a location external to each said connector body.

17. The method of claim 1, wherein each said coupling circuit is further configured to receive said electrical signal.

18. The method of claim 1, wherein each said coupling circuit comprises a coupling device.

19. The method of claim 18, wherein each said coupling device is coupled to a center conductor of an associated coaxial cable connector of said plurality of coaxial cable connectors.

20. The method of claim 19, wherein each said coupling device is directly coupled to said center conductor of said associated coaxial cable connector.

21. The method of claim 19, wherein each said coupling device is indirectly coupled to said center conductor of said associated coaxial cable connector.

22. The method of claim 18, wherein each said coupling device is an antenna.

23. The method of claim 1, wherein each said coupling circuit comprises a plurality of coupling devices each coupled to a center conductor of an associated coaxial cable connector of said plurality of coaxial cable connectors.

24. A signal level detection method comprising:

providing a computing system comprising a computer processor;

receiving, by said computer processor from a plurality of electrical signal power level detection circuits comprised by a plurality of coaxial cable connectors, a first plurality of power levels of an electrical signal flowing through each coaxial cable connector of said plurality of coaxial cable connectors, wherein said plurality of coaxial cable connectors are comprised by a transmission system comprising a signal receiving device, a signal emitting source, and a feed line system connected between said signal receiving device and said signal emitting source, wherein said feed line system comprises said plurality of coaxial cable connectors connected between a plurality of coaxial cable sections, wherein each coaxial cable connector of said coaxial cable connectors comprises a connector body, a coupling circuit positioned within the connector body, an electrical signal power level detection circuit of said plurality of electrical signal power level detection circuits comprised by the connector body, and an output component comprised by the connector body, and wherein each said coupling circuit senses said electrical signal flowing through an associated coaxial cable connector of said plurality of coaxial cable connectors;

comparing, by said computer processor, each power level of said first plurality of power levels to each other power level of said first plurality of power levels;

first determining, by said computer processor based on results of said comparing, that there are first distinct power levels of said plurality of power levels; and second determining, by said computer processor based on said first distinct power levels, that a malfunction may be present at a location associated with at least one coaxial cable connector of said plurality of coaxial cable connectors or a location associated with said feed system.

25. The method of claim 24, wherein said computing system further comprises a memory structure in communication with said computer processor, and wherein said method further comprises:

storing, by said memory structure, a quantity of said first distinct power levels;

comparing, by said computer processor, said quantity to a predetermined threshold; and determining, by said computer processor, that said quantity exceeds said predetermined threshold; and transmitting, by said computer processor to a user, a warning indicator indicating that said malfunction may be present.

26. The method of claim 24, further comprising:

transmitting, by said computer processor to a user, a warning indicator indicating that said malfunction may be present.

27. The method of claim 24, wherein said second determining determines that said malfunction is present at said location associated with said at least one coaxial cable connector of said plurality of coaxial cable connectors or said location associated with said feed system, wherein said malfunction comprises passive intermodulation (PIM), and wherein said first distinct power levels are used to determine that said passive intermodulation (PIM) exists at said location associated with said at least one coaxial cable connector of said plurality of coaxial cable connectors or said location associated with said feed system.

28. The method of claim 24, wherein said plurality of coaxial cable connectors are connected to RF ports, wherein each said coaxial cable connector additionally comprises a physical parameter status sensing circuit comprised by said connector body, and wherein said method further comprises:

receiving, by said computer processor from each said physical parameter status sensing circuit, a condition associated with each associated coaxial cable connector of said plurality of coaxial cable connectors connected to an associated RF port, wherein said second determining is further based on each said condition.

29. The method of claim 28, wherein said second determining determines that said malfunction is present at said location associated with said at least one coaxial cable connector of said plurality of coaxial cable connectors or said location associated with said feed system, wherein said malfunction comprises passive intermodulation (PIM), and wherein said first distinct power levels are used to determine that said passive intermodulation (PIM) exists at said location associated with said at least one coaxial cable connector of said plurality of coaxial cable connectors or said location associated with said feed system.

30. The method of claim 24, further comprising:

transmitting, by said computer processor to a user, a warning indicator indicating that said malfunction may be present;

retrieving, by said computer processor from said plurality of electrical signal power level detection circuits in response to a command from said user, an additional plurality of power levels of said electrical signal;

second comparing, by said computer processor, each additional power level of said plurality of additional power levels to each other additional power level of said plurality of additional power levels;

determining, by said computer processor based on results of said second comparing, that there are second distinct power levels of said plurality of additional power levels;

determining, by said computer processor, a first power level of said additional plurality of power levels comprising a higher power level than each other power level of said additional plurality of power levels;

associating, by said computer processor, a first coaxial cable connector of said plurality of coaxial cable connectors with said first power level; and determining, by said computer processor based on said first power level, that a malfunction is present proximate to said first coaxial cable connector.

31. The method of claim 30, wherein said warning indicator is transmitted to said user at a remote location, and wherein said command is retrieved from said user from said remote location.

32. The method of claim 30, wherein said malfunction comprises passive intermodulation (PIM).

33. The method of claim 30, wherein said plurality of coaxial cable connectors are connected to RF ports, wherein each said coaxial cable connector additionally comprises a physical parameter status sensing circuit comprised by the connector body, and wherein said method further comprises:

receiving, by said computer processor from each said physical parameter status sensing circuit, a conditions associated with each associated coaxial cable connector of said plurality of coaxial cable connectors connected to an associated RF port, wherein determining that said malfunction is present proximate to said first coaxial cable connector is further based on a first condition of said conditions, and wherein said first condition is associated with said first coaxial cable connector.

34. The method of claim 33, wherein said malfunction comprises passive intermodulation (PIM).

35. The method of claim 24, further comprising:

storing, by said computer processor based, data associated with said first distinct power levels;

transmitting, by said computer processor to a user, a warning indicator indicating that said malfunction may be present;

receiving, by said computer processor from said user in response to said warning indicator, a command for retrieving said data;

presenting, by said computer processor to said user in response to said command, said data.

36. The method of claim 35, further comprising:

receiving, by said computer processor from said user in response to said presenting, indication data specifying that a first power level of said first distinct power levels comprises a higher power level than each other power level of said first distinct power levels;

determining, by said computer processor, a first coaxial cable connector of said plurality of coaxial cable connectors associated with said first power level; and determining, by said computer processor based on said first power level, that a malfunction is present proximate to said first coaxial cable connector.

37. The method of claim 36, wherein said command for retrieving said data is received from said user at a remote location, wherein said data is presented to said user at said remote location, and wherein said indication data is received from said user from said remote location.

38. The method of claim 36, wherein said malfunction comprises passive intermodulation (PIM).

39. The method of claim 36, wherein said plurality of coaxial cable connectors are connected to RF ports, wherein each said coaxial cable connector additionally comprises a physical parameter status sensing circuit comprised by the connector body, and wherein said method further comprises:

receiving, by said computer processor from each said physical parameter status sensing circuit, conditions associated with each associated coaxial cable connector of said plurality of coaxial cable connectors connected to an associated RF port, wherein determining that said malfunction is present proximate to said first coaxial cable connector is further based on a first condition of said conditions, and wherein said first condition is associated with said first coaxial cable connector.

40. The method of claim 39, wherein said malfunction comprises passive intermodulation (PIM).

41. The method of claim 24, wherein each said power level of said first plurality of power levels is associated with a single coaxial cable connector of said plurality of coaxial cable connectors.

42. The method of claim 24, wherein each said power level of said first plurality of power levels is associated with a different coaxial cable connector of said plurality of coaxial cable connectors.

* * * * *